US011749929B2

(12) United States Patent
Saitou et al.

(10) Patent No.: US 11,749,929 B2
(45) Date of Patent: Sep. 5, 2023

(54) CONNECTOR USING CONTACT PRESSURE OBTAINED BY PRESS-FITTING HOLDING MEMBER INTO SHELL

(71) Applicant: Japan Aviation Electronics Industry, Limited, Tokyo (JP)

(72) Inventors: Kimiaki Saitou, Tokyo (JP); Hiroaki Kuribayashi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 17/579,134

(22) Filed: Jan. 19, 2022

(65) Prior Publication Data

US 2022/0302623 A1 Sep. 22, 2022

(30) Foreign Application Priority Data

Mar. 18, 2021 (JP) ..... 2021-044268

(51) Int. Cl.
*H01R 13/424* (2006.01)
*H01R 24/60* (2011.01)
*H01R 107/00* (2006.01)

(52) U.S. Cl.
CPC ..... *H01R 13/424* (2013.01); *H01R 24/60* (2013.01); *H01R 2107/00* (2013.01)

(58) Field of Classification Search
CPC .. H01R 13/424; H01R 13/502; H01R 13/648; H01R 13/6582; H01R 13/6585; H01R 24/60; H01R 2107/00
See application file for complete search history.

(56) References Cited

U.S. PATENT DOCUMENTS 9,214,767 B1 * 12/2015 Yu ..... H01R 24/60
9,698,537 B2 * 7/2017 Yokoyama ..... H01R 24/64
10,205,290 B2 2/2019 Tsai
2018/0115102 A1 * 4/2018 Peng ..... H01R 13/405
(Continued)

FOREIGN PATENT DOCUMENTS

CN 204927638 U 12/2015
CN 107026341 A 8/2017
(Continued)

OTHER PUBLICATIONS

Taiwanese Office Action dated May 11, 2023 in Taiwanese Application No. 111 102 732, with English translation.

*Primary Examiner* — Oscar C Jimenez
(74) *Attorney, Agent, or Firm* — Collard & Roe, P.C.

(57) ABSTRACT

A connector comprises two holding members, two terminal rows, a midplate and a shell. Each of the holding members is lightly press-fit into the shell. Each of the terminal rows has a plurality of terminals. The terminals of each of the terminal rows include a specific terminal. The specific terminal has an exposed portion. The exposed portion is, at least in part, exposed from the holding member in an up-down direction perpendicular to a pitch direction. The midplate has a receiving portion. The exposed portion is brought into contact with the receiving portion. One of the holding member and the shell is formed with at least one light press-fit portion. A position of the at least one light press-fit portion overlaps with a position of the exposed portion in a front-rear direction perpendicular to both the up-down direction and the pitch direction.

12 Claims, 30 Drawing Sheets

(56) References Cited

U.S. PATENT DOCUMENTS

| | | | | |
|---|---|---|---|---|
| 2018/0212366 | A1* | 7/2018 | Chang | H01R 13/405 |
| 2018/0309243 | A1 | 10/2018 | Kurosawa | |

FOREIGN PATENT DOCUMENTS

| | | | |
|---|---|---|---|
| CN | 107251333 | B | 10/2017 |
| CN | 210607747 | U | 5/2020 |
| TW | M493802 | U | 1/2015 |
| TW | M537747 | U | 3/2017 |
| TW | M554235 | A | 1/2018 |

* cited by examiner

CONNECTOR USING CONTACT PRESSURE OBTAINED BY PRESS-FITTING HOLDING MEMBER INTO SHELL

CROSS REFERENCE TO RELATED APPLICATIONS

This application is based on and claims priority under 35 U.S.C. § 119 to Japanese Patent Application No. JP2021-044268 filed Mar. 18, 2021, the contents of which are incorporated herein in their entirety by reference.

BACKGROUND OF THE INVENTION

This invention relates to a connector comprising a terminal row and a midplate.

Referring to FIGS. 53 and 54, a connector 900 of CN204927638 (Patent Document 1) comprises two holding members 910, two terminal rows 920, a midplate 940 and a shell 950. The holding members 910 correspond to the terminal rows 920, respectively. Each of the terminal rows 920 is held by the corresponding holding member 910. Each of the terminal rows 920 has a plurality of terminals 922. In each terminal row 920, the terminals 922 are arranged in a Y-direction. The terminals 922 of each of the terminal rows 920 include two specific terminals 924. Each of the specific terminals 924 has a protruding portion 9242. The midplate 940 is sandwiched by the two holding members 910 in a Z-direction. The midplate 940 has spring pieces 942, 944. The protruding portion 9242 of the specific terminal 924, which is positioned at a positive Z-side of the midplate 940, is in contact with the spring piece 942. The protruding portion 9242 of the specific terminal 924, which is positioned at a negative Z-side of the midplate 940, is in contact with the spring piece 944.

In the connector 900 of Patent Document 1, the protruding portion 9242 is formed by bending a part of the specific terminal 924. The spring piece 942, 944 is formed by cutting a part of the midplate 940 and bending the part. The spring piece 942, 944 is pressed against the protruding portion 9242. The connector 900 of Patent Document 1 ensures reliable contact between the specific terminal 924 and the midplate 940 by the spring characteristic of the spring piece 942, 944.

There is a need for a connector to ensure more reliable contact between a specific terminal and a midplate by its structure which is different from a structure of a conventional connector such as the connector 900 of Patent Document 1

SUMMARY OF THE INVENTION

It is therefore an object of the present invention to provide a connector which can ensure more reliable contact between a specific terminal and a midplate by its structure different from a structure of a conventional connector.

One aspect of the present invention provides a connector comprising two holding members, two terminal rows, a midplate and a shell. The holding members correspond to the terminal rows, respectively. Each of the holding members is lightly press-fit into the shell. Each of the terminal rows is held by the corresponding holding member. Each of the terminal rows has a plurality of terminals. In each terminal row, the terminals are arranged in a pitch direction. The terminals of each of the terminal rows include a specific terminal. The specific terminal has an exposed portion. The exposed portion is, at least in part, exposed from the holding member in an up-down direction perpendicular to the pitch direction. The midplate is sandwiched by the holding members in the up-down direction. The midplate has a receiving portion. The exposed portion is brought into contact with the receiving portion. One of the holding member and the shell is formed with at least one light press-fit portion. A position of the at least one light press-fit portion overlaps with a position of the exposed portion in a front-rear direction perpendicular to both the up-down direction and the pitch direction.

The connector of the present invention is configured as follows: each of the holding members is lightly press-fit into the shell; the exposed portion of the specific terminal is brought into contact with the receiving portion of the midplate; one of the holding member and the shell is formed with the at least one light press-fit portion; and the position of the at least one light press-fit portion overlaps with the position of the exposed portion in the front-rear direction perpendicular to both the up-down direction and the pitch direction. Specifically, the connector of the present invention is configured so that the specific terminal, which is held by the holding member, is brought into contact with the midplate by a contact pressure which is obtained by lightly press-fitting the holding member into the shell. This enables the connector of the present invention to ensure more reliable contact between the specific terminal and the midplate by its structure different from a structure of the connector 900 of Patent Document 1.

An appreciation of the objectives of the present invention and a more complete understanding of its structure may be had by studying the following description of the preferred embodiment and by referring to the accompanying drawings.

Figure 1:
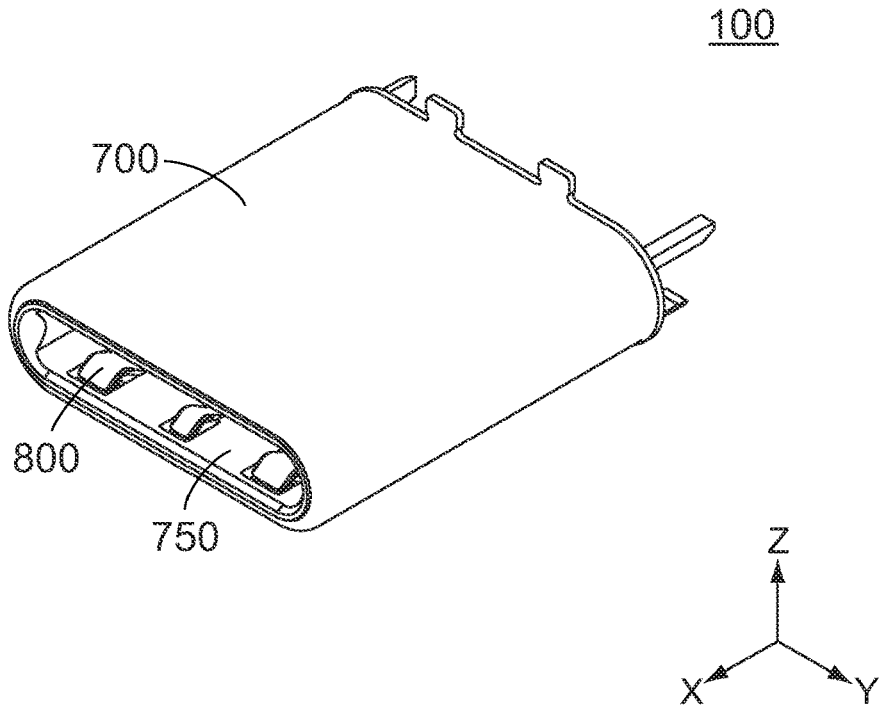
FIG. 1 is a perspective view showing a connector according to a first embodiment of the present invention.
Figure 2:
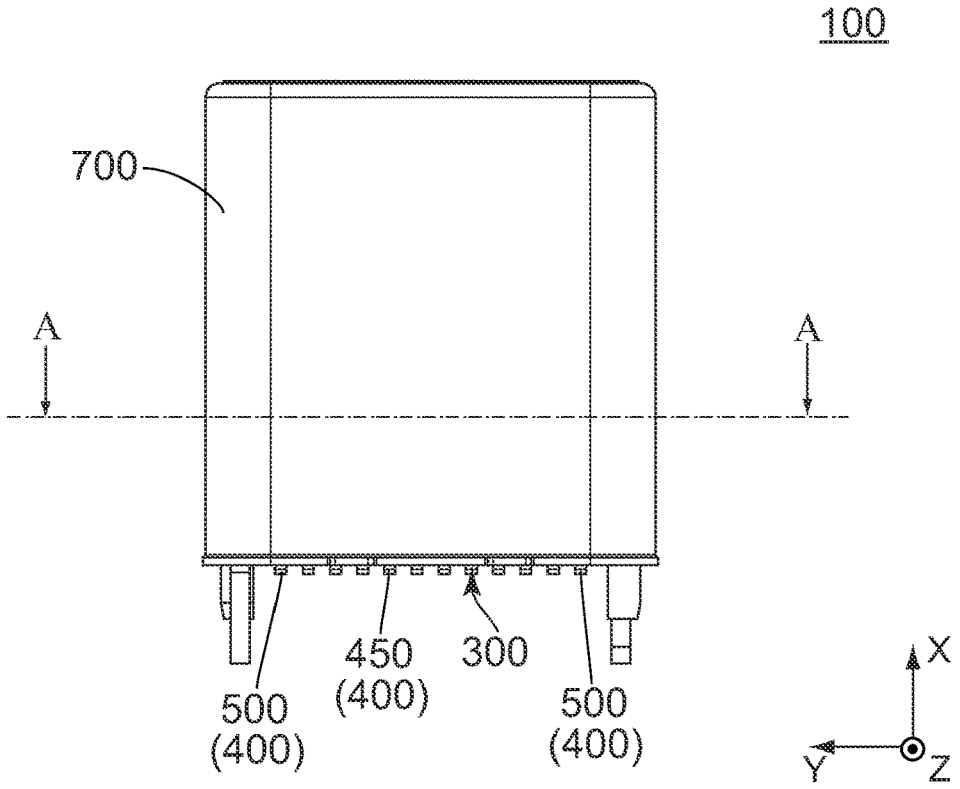
FIG. 2 is a top view showing the connector of FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

First Embodiment

Referring to FIG. 1, a connector 100 according to a first embodiment of the present invention is mateable along a front-rear direction with a mating connector (not shown) which comprises mating contacts (not shown). In the present embodiment, the front-rear direction is an X-direction. Specifically, it is assumed that forward is a positive X-direction while rearward is a negative X-direction. In detail, the connector 100 of the present embodiment is a plug which is mateable with a USB (Universal Serial Bus) Type-C receptacle. However, the present invention is not limited thereto. Specifically, the connector 100 may be a plug which is mateable with a receptacle other than a USB (Universal Serial Bus) Type-C receptacle.

Figure 3:
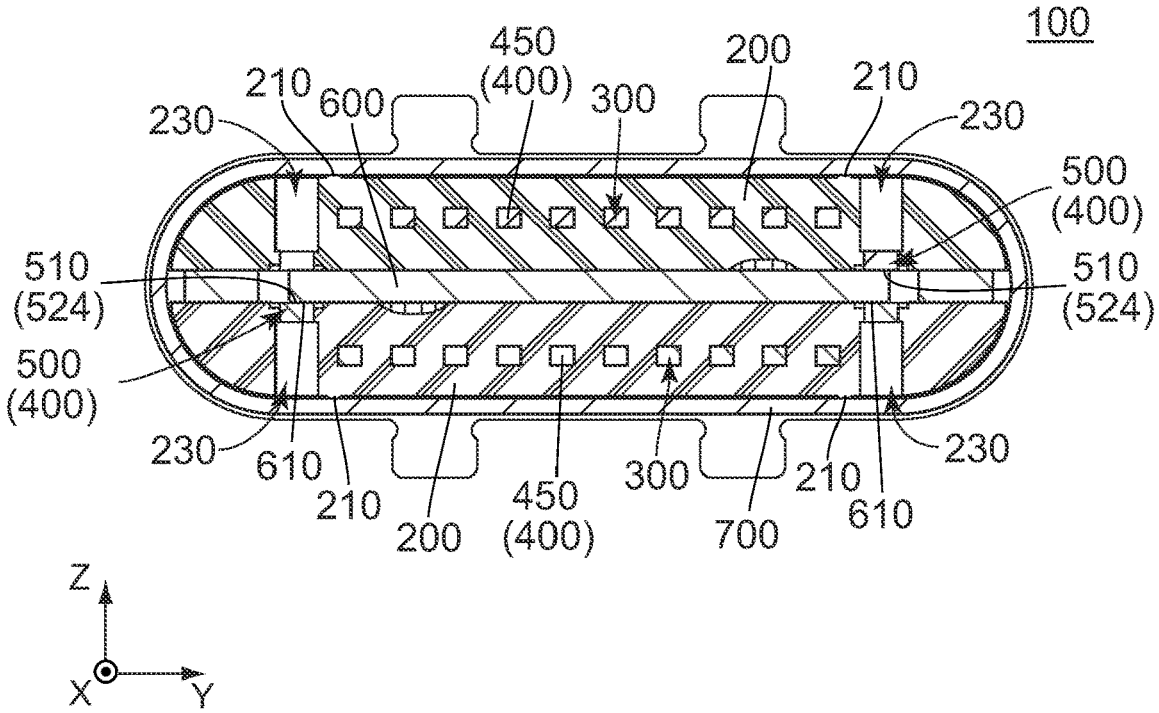
FIG. 3 is a cross-sectional view showing the connector of FIG. 2, taken along line A-A.
Figure 8:
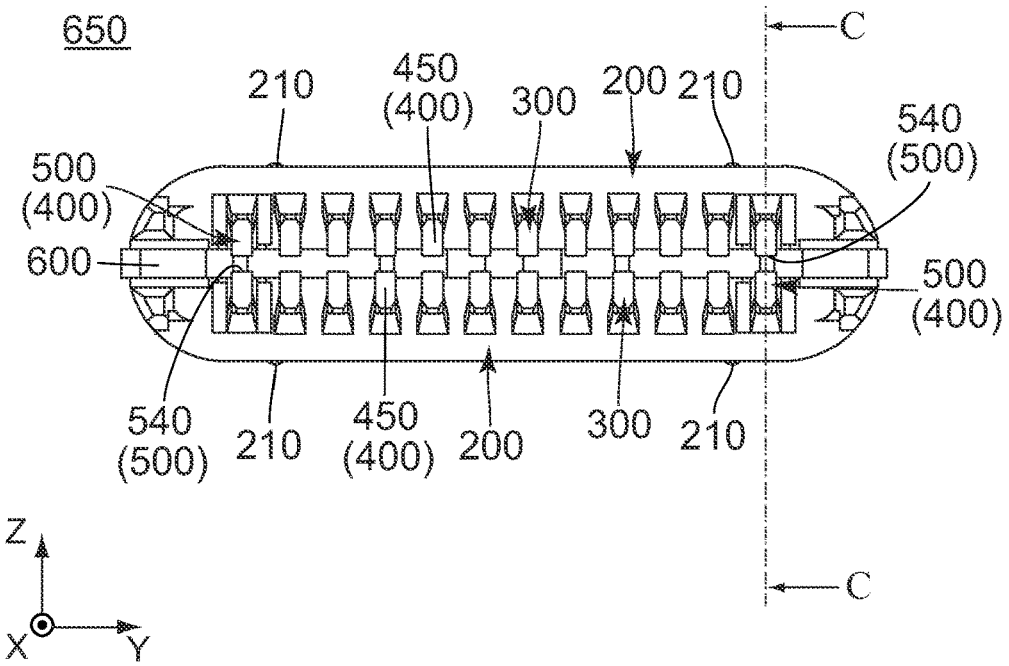
FIG. 8 is a front view showing the structural body of FIG. 7.

As shown in FIG. 3, the connector 100 comprises two holding members 200, two terminal rows 300, a midplate 600 and a shell 700. As shown in FIG. 8, the two holding members 200, the two terminal rows 300 and the midplate 600 form a structural body 650.

Referring to FIG. 8, each of the holding members 200 of the present embodiment is made of resin. The holding members 200 correspond to the terminal rows 300, respectively. The holding members 200 are positioned away from each other in an up-down direction with the midplate 600 left therebetween in the up-down direction. In the present embodiment, the up-down direction is a Z-direction. Specifically, it is assumed that upward is a positive Z-direction while downward is a negative Z-direction. Referring to FIG. 3, each of the holding members 200 is lightly press-fit into the shell 700. Specifically, each of the holding members 200 is directly and lightly press-fit into the shell 700. Each of the holding members 200 is formed with a plurality of light press-fit portions 210. More specifically, each of the holding members 200 is formed with two of the light press-fit portions 210. However, the present invention is not limited thereto. Specifically, one of the holding member 200 and the shell 700 should be formed with at least one light press-fit portion 210.

Figure 5:
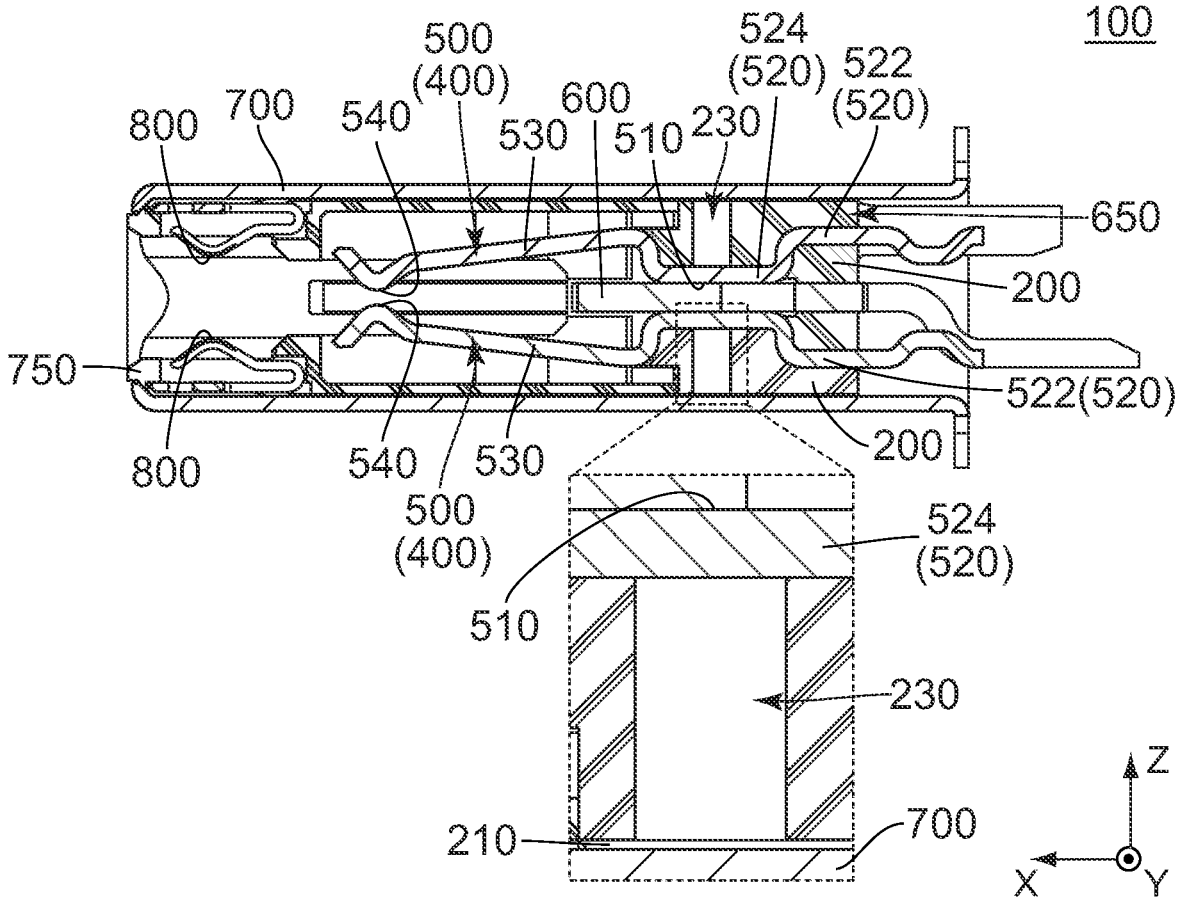
FIG. 5 is a cross-sectional view showing the connector of FIG. 4, taken along line B-B. In the figure, a part of a structural body is illustrated enlarged.
Figure 7:
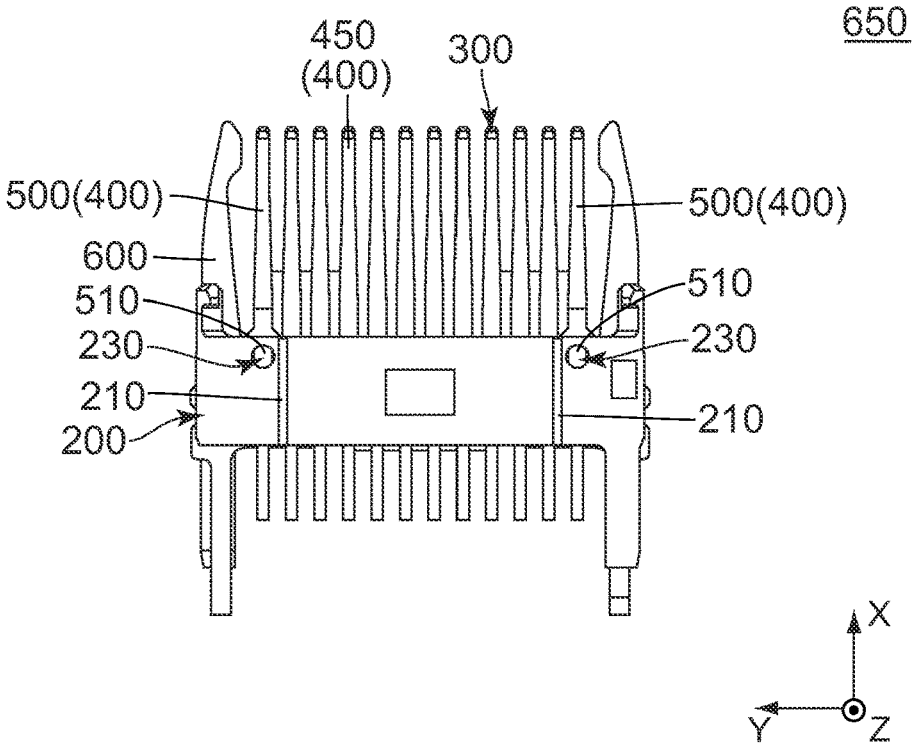
FIG. 7 is a top view showing the structural body which is included in the connector of FIG. 2. In the figure, a midplate is sandwiched by two holding members in an up-down direction.

As understood from FIGS. 7 and 8, each of the light press-fit portions 210 of the present embodiment is a projecting rib which protrudes outward in the up-down direction and extends in the front-rear direction. The two light press-fit portions 210 are provided on each of the holding members 200. As shown in FIGS. 3 and 5, each of the light press-fit portions 210 is brought into contact with the shell 700. More specifically, each of the light press-fit portions 210 is brought into contact with an inner side of shell 700 in the up-down direction. Each of the light press-fit portions 210 is brought into line contact with the inner side of the shell 700 in the up-down direction.

Referring to FIG. 7, each of the holding members 200 of the present embodiment is formed with two holes 230. However, the present invention is not limited thereto, but the number of the hole 230 may be one.

Referring to FIGS. 3 and 7, each of the holes 230 of the present embodiment has a substantially cylindrical tube shape extending in the up-down direction. Each of the holes 230 pierces the holding member 200 in the up-down direction. The hole 230 neighbors to the light press-fit portion 210 in a pitch direction. Specifically, the holes 230 correspond to the light press-fit portions 210, respectively, and each of the holes 230 neighbors to the corresponding light press-fit portion 210 in the pitch direction. More specifically, in the pitch direction, each of the holes 230 is positioned outward beyond the corresponding light press-fit portion 210 and neighbors to the corresponding light press-fit portion 210. In other words, each of the light press-fit portions 210 neighbors to the corresponding hole 230 in the pitch direction. More specifically, in the pitch direction, each of the light press-fit portions 210 is positioned inward beyond the corresponding hole 230 and neighbors to the corresponding hole 230. In the present embodiment, the pitch direction is a Y-direction.

As shown in FIG. 8, the terminal rows 300 are positioned away from each other in the up-down direction with the midplate 600 left therebetween in the up-down direction. Each of the terminal rows 300 is held by the corresponding holding member 200. More specifically, each of the terminal rows 300 is insert-molded in the corresponding holding member 200.

As described above, each of the light press-fit portions 210 is brought into contact with the shell 700 and each of the terminal rows 300 is held by the corresponding holding member 200. Specifically, an attitude of each of the terminal rows 300 relative to the shell 700 is defined by contact states of the light press-fit portions 210 on the shell 700. In the connector 100 of the present embodiment, each of the light press-fit portions 210 is brought into line contact with the inner side of the shell 700 in the up-down direction as described above. This enables the attitude of each of the terminal rows 300 relative to the shell 700 to be horizontal which is its proper attitude. This can also prevent a deviation of the attitude of each of the terminal rows 300 from the proper attitude. From this perspective, it is desirable that the light press-fit portion 210 is the projecting rib extending as long as possible in the front-rear direction.

As shown in FIG. 8, each of the terminal rows 300 has a plurality of terminals 400.

Figure 14:
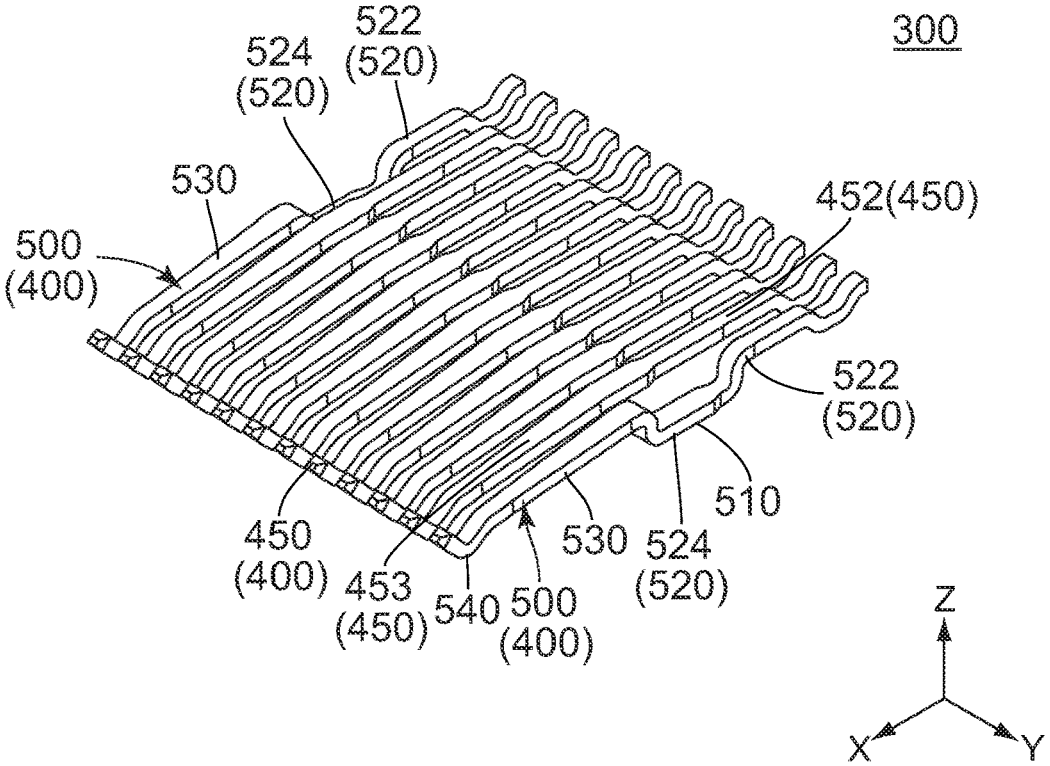
FIG. 14 is a perspective view showing one of the terminal rows which are included in the connector of FIG. 6.
Figure 15:
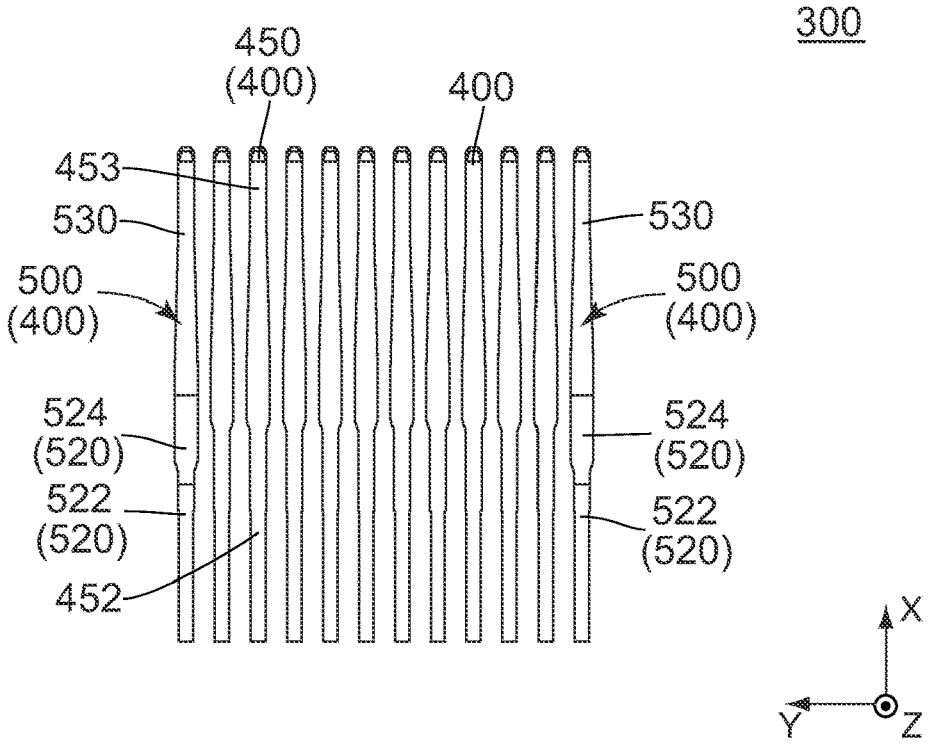
FIG. 15 is a top view showing the terminal row of FIG. 14.
Figure 16:
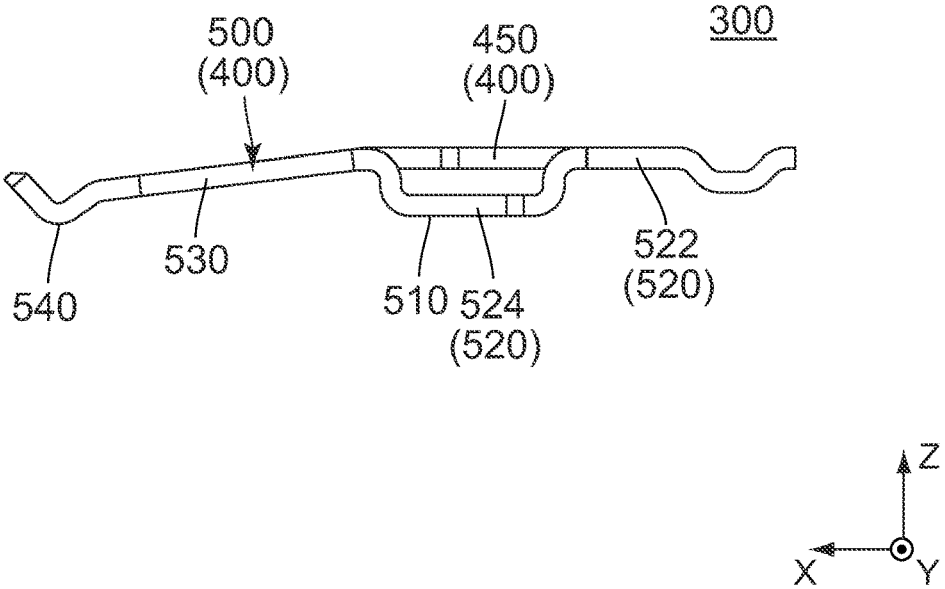
FIG. 16 is a side view showing the terminal row of FIG. 14.
Figure 17:
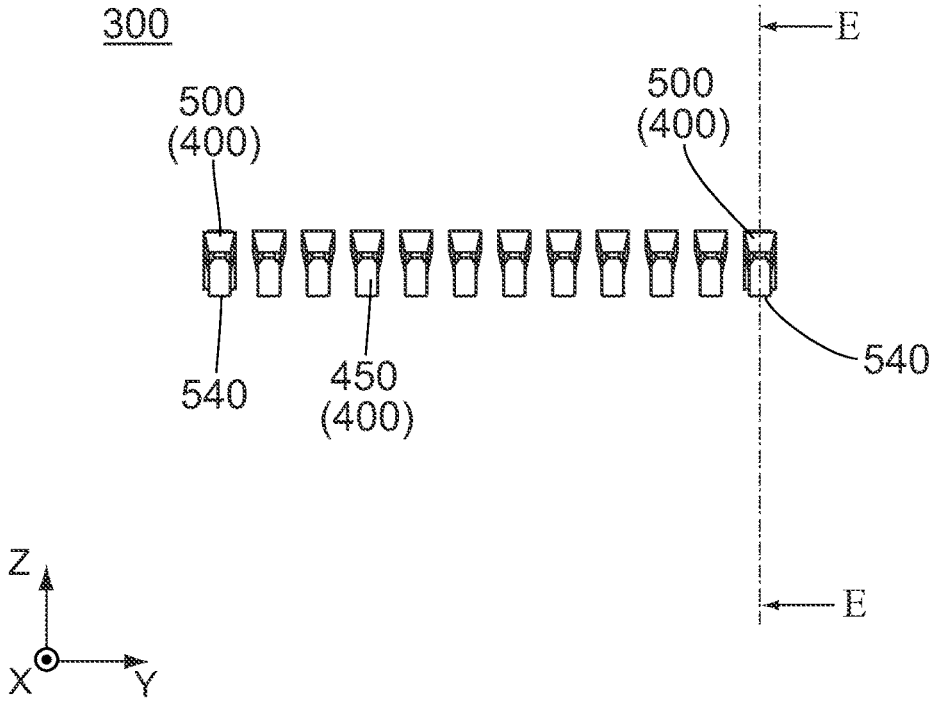
FIG. 17 is a front view showing the terminal row of FIG. 14.
Figure 18:
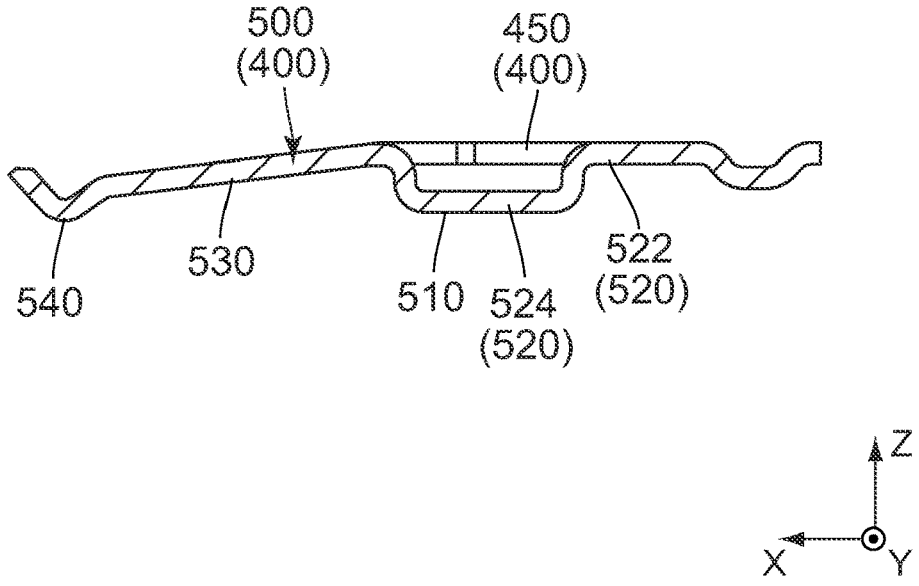
FIG. 18 is a cross-sectional view showing the terminal row of FIG. 17, taken along line E-E.

Referring to FIG. 14, each of the terminals 400 of the present embodiment is made of metal. In each terminal row 300, the terminals 400 are arranged in the pitch direction. The terminals 400 of each of the terminal rows 300 include a plurality of signal terminals 450 and two specific terminals 500. However, the present invention is not limited thereto. Specifically, the terminals 400 of each of the terminal rows 300 should include at least one specific terminal 500.

Figure 11:
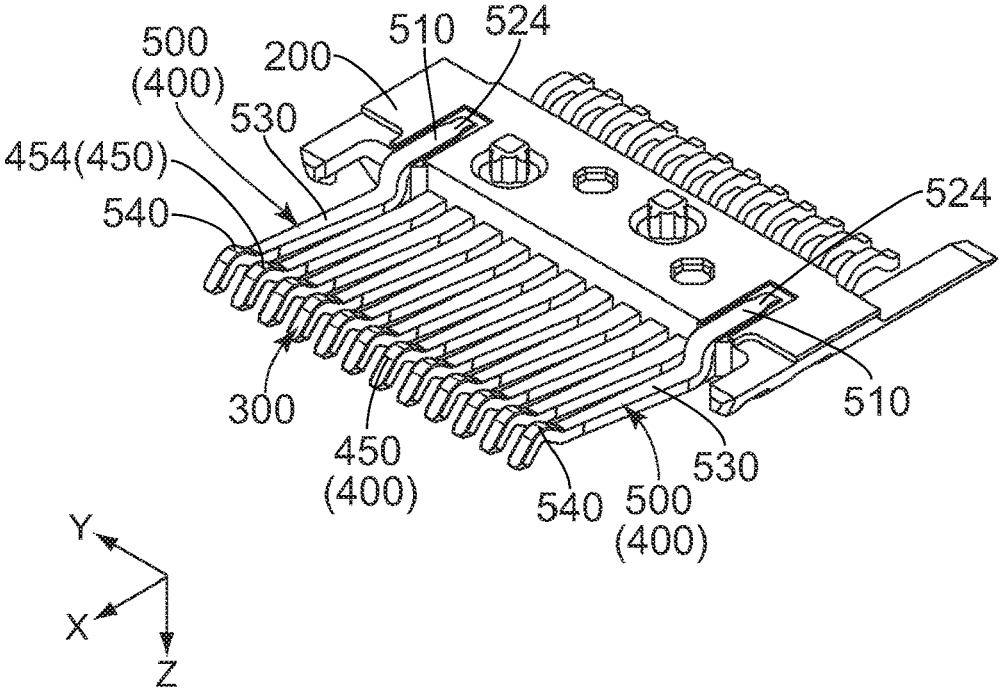
FIG. 11 is a perspective view showing a set of one of terminal rows and one of the holding members, wherein the terminal rows and the holding members are included in the connector of FIG. 6.
Figure 12:
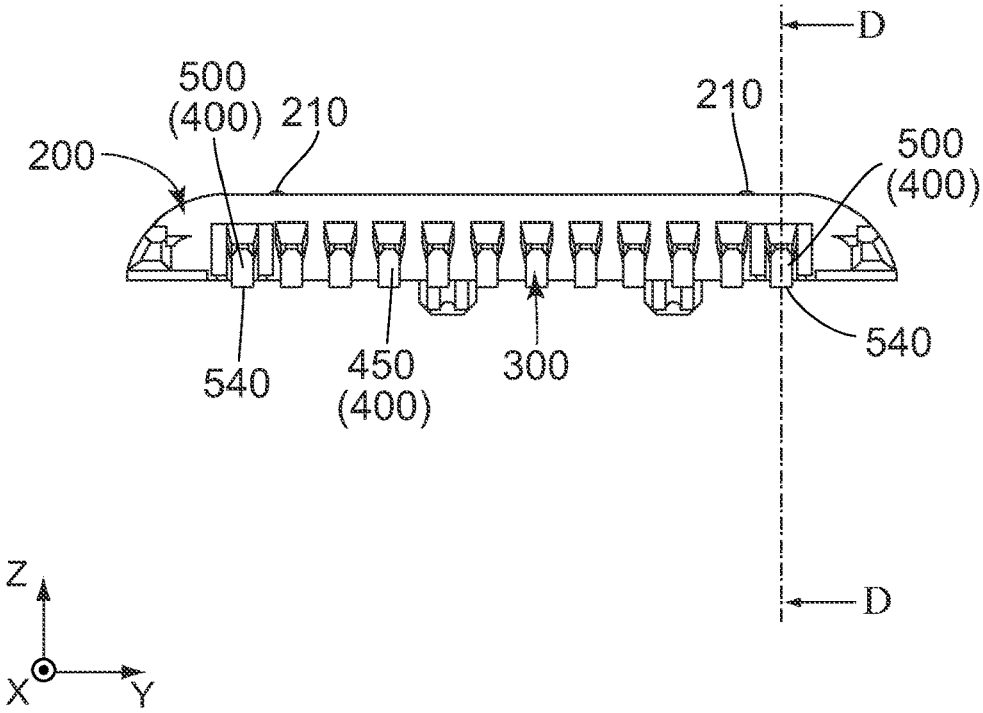
FIG. 12 is a front view showing the set of the terminal row and the holding member of FIG. 11.

As shown in FIGS. 11 and 14, each of the signal terminals 450 of the present embodiment has a held portion 452, a supporting portion 453 and a contact portion 454.

As shown in FIG. 14, the held portion 452 of the present embodiment is positioned rearward of the supporting portion 453 in the front-rear direction. Referring to FIGS. 11 and 14, the held portion 452 is partially held by the holding member 200.

Referring to FIG. 14, the supporting portion 453 of the present embodiment is resiliently deformable. The supporting portion 453 extends forward in the front-rear direction from the held portion 452.

Referring to FIGS. 11 and 14, the contact portion 454 of the present embodiment is supported by the supporting portion 453 so as to be movable in the up-down direction. The contact portion 454 is positioned around a front end of the signal terminal 450 in the front-rear direction.

As shown in FIG. 11, each of the specific terminals 500 of the present embodiment has an exposed portion 510.

Figure 9:
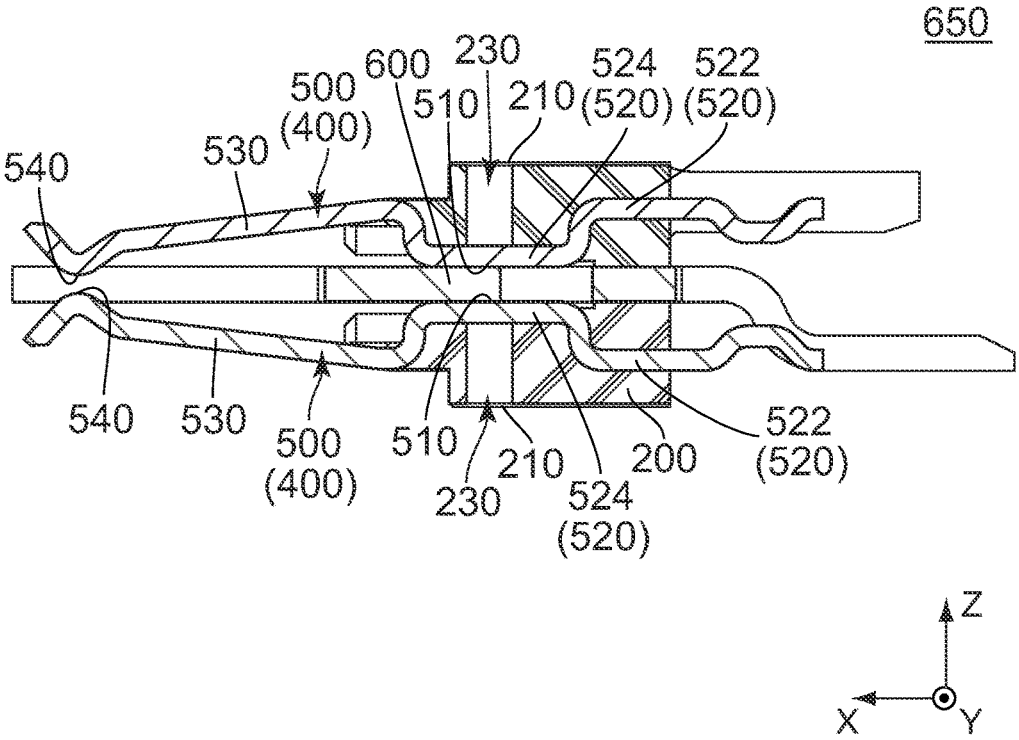
FIG. 9 is a cross-sectional view showing the structural body of FIG. 8, taken along line C-C.

As shown in FIG. 11, the exposed portion 510 of the present embodiment has a plate-like shape intersecting with the up-down direction. More specifically, the exposed portion 510 has the plate-like shape perpendicular to the up-down direction. The exposed portion 510 is exposed from the holding member 200 in the up-down direction. However, the present invention is not limited thereto. Specifically, the exposed portion 510 should be, at least in part, exposed from the holding member 200 in the up-down direction perpendicular to the pitch direction. As shown in FIG. 9, the hole 230 and the exposed portion 510 are positioned on a common axis parallel to the up-down direction. Specifically, the holes 230 correspond to the exposed portions 510, respectively, and the hole 230 and the corresponding exposed portion 510 are positioned on the common axis parallel to the up-down direction. The hole 230 reaches the corresponding exposed portion 510 in the up-down direction. The exposed portion 510 is positioned between the corresponding hole 230 and the midplate 600 in the up-down direction. The exposed portion 510 is positioned inward beyond the corresponding hole 230 in the up-down direction. The exposed portion 510 is positioned at a position same as that of the corresponding hole 230 in the front-rear direction. As shown in FIG. 3, the exposed portion 510 is positioned at a position same as that of the corresponding hole 230 in the pitch direction. The exposed portion 510 is positioned outward beyond the midplate 600 in the up-down direction. The light press-fit portion 210 is positioned inward beyond the exposed portion 510 in the pitch direction. Specifically, the light press-fit portions 210 correspond to the exposed portions 510, respectively, and the light press-fit portion 210 is positioned inward beyond the corresponding exposed portion 510 in the pitch direction. As shown in FIG. 9, a position of the light press-fit portion 210 overlaps with a position of the corresponding exposed portion 510 in the front-rear direction perpendicular to both the up-down direction and the pitch direction. Each of the aforementioned holes 230 is a hollowed place formed in the holding member 200 as follows: the specific terminals 500 are insert-molded in the holding member 200 while parts of a metal mold abut against the exposed portions 510 from their outer sides in the up-down direction so that each of the exposed portions 510 is appropriately exposed from the holding member 200; and the parts of the metal mold are removed from the molded holding member 200.

As described above, each of the holding members 200 is lightly press-fit into the shell 700, and the position of the light press-fit portion 210 overlaps with the position of the corresponding exposed portion 510 in the front-rear direction perpendicular to both the up-down direction and the pitch direction. Accordingly, the connector 100 of the present embodiment is configured so that the specific terminals 500, which are held by the holding members 200, are brought into contact with the midplate 600 by a contact pressure which is obtained by lightly press-fitting the holding members 200 into the shell 700. This enables the connector 100 of the present embodiment to ensure more reliable contact between each of the specific terminals 500 and the midplate 600 by its structure different from a structure of the connector 900 of Patent Document 1.

As shown in FIG. 14, the specific terminal 500 of the present embodiment has a held portion 520, a supporting portion 530 and a contact portion 540.

Figure 13:
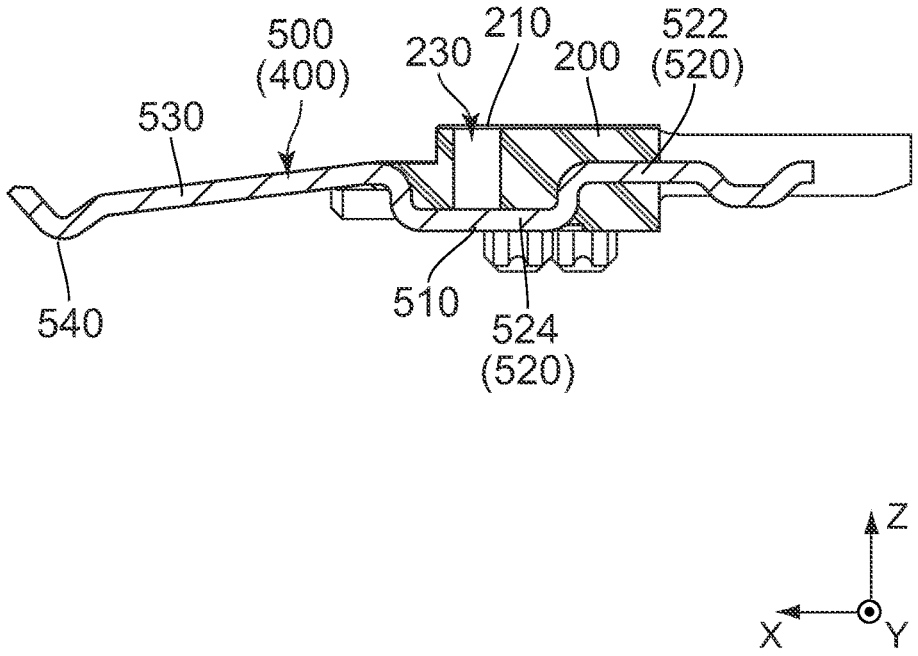
FIG. 13 is a cross-sectional view showing the set of the terminal row and the holding member of FIG. 12, taken along line D-D.

As shown in FIG. 13, the held portion 520 of the present embodiment is positioned rearward of the supporting portion 530 in the front-rear direction. The held portion 520 is, at least in part, held by the holding member 200. The exposed portion 510 is formed on the held portion 520. The held portion 520 has an embedded portion 522 and a protruding portion 524.

As shown in FIG. 13, the embedded portion 522 of the present embodiment is positioned rearward of the protruding portion 524 in the front-rear direction. The embedded portion 522 is positioned outward beyond the exposed portion 510 in the up-down direction. The embedded portion 522 is embedded in the holding member 200. The exposed portion 510 is positioned between the contact portion 540 and the embedded portion 522 in the front-rear direction. The exposed portion 510 is positioned between the supporting portion 530 and the embedded portion 522 in the front-rear direction.

As shown in FIG. 9, the protruding portion 524 of the present embodiment is positioned forward of the embedded portion 522 in the front-rear direction. The protruding portion 524 protrudes toward the midplate 600 beyond any of the embedded portion 522 and the supporting portion 530. The protruding portion 524 is positioned between the contact portion 540 and the embedded portion 522 in the front-rear direction. The protruding portion 524 is positioned between the supporting portion 530 and the embedded portion 522 in the front-rear direction. The supporting portion 530 extends forward in the front-rear direction from the protruding portion 524. The exposed portion 510 is provided on the protruding portion 524.

Referring to FIGS. 7 and 9, the protruding portion 524 is, at least in part, covered by the holding member 200 at any place of the protruding portion 524 in the front-rear direction. This can easily match a position of the contact portion 540 of the specific terminal 500 with a position of the contact portion 454 (see FIG. 11) of the signal terminal 450 in the up-down direction when the terminal row 300 is insert-molded in the corresponding holding member 200.

Referring to FIG. 14, the supporting portion 530 of the present embodiment is resiliently deformable. The supporting portion 530 extends forward in the front-rear direction from the held portion 520. As shown in FIG. 13, a part of the supporting portion 530 is held by the holding member 200. More specifically, a rear end of the supporting portion 530 is held by the holding member 200.

As shown in FIG. 14, the contact portion 540 of the present embodiment is supported by the supporting portion 530 so as to be movable in the up-down direction. The contact portion 540 is positioned around a front end of the specific terminal 500 in the front-rear direction.

Figure 10:
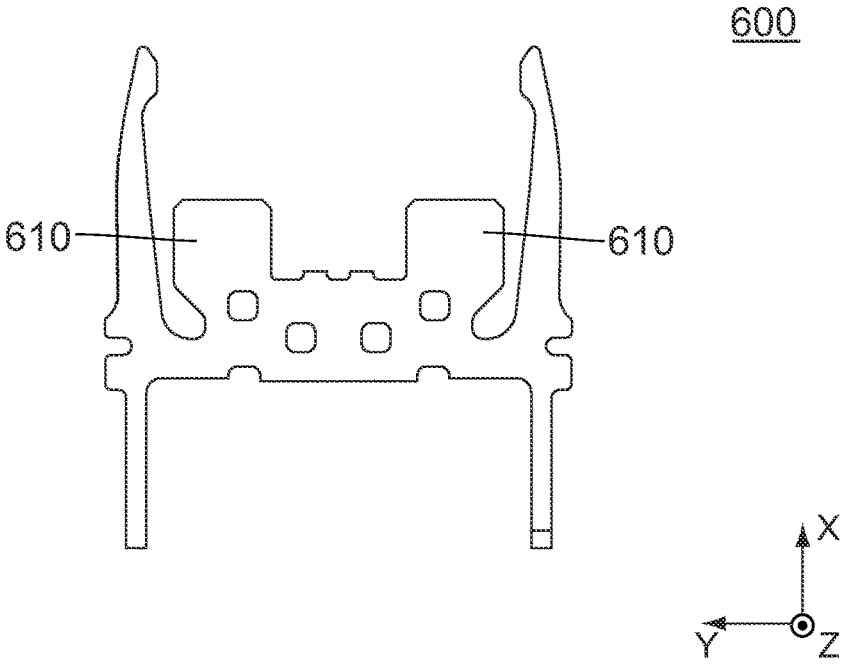
FIG. 10 is a top view showing the midplate which is included in the connector of FIG. 2.

Referring to FIG. 10, the midplate 600 of the present embodiment is made of metal. The midplate 600 has receiving portions 610. Each of the receiving portions 610 has a plate-like shape perpendicular to the up-down direction. As shown in FIG. 3, the midplate 600 is sandwiched by the holding members 200 in the up-down direction. The exposed portion 510 is brought into contact with the receiving portion 610. More specifically, the exposed portion 510 is pressed against the receiving portion 610. The exposed portion 510 is pressed against the receiving portion 610 from its outer side in the up-down direction.

Figure 4:
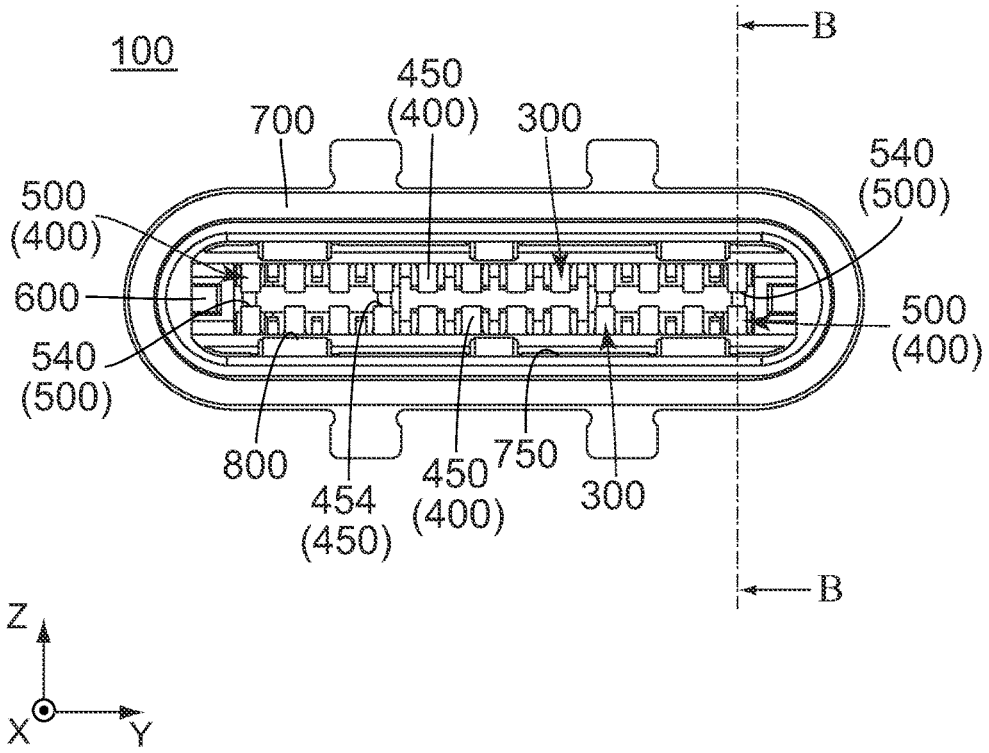
FIG. 4 is a front view showing the connector of FIG. 1.

Referring to FIG. 4, the shell 700 of the present embodiment is made of metal. The shell 700 has a tube shape whose cross-section is roughly elliptical. The shell 700 defines an outer end of the connector 100 in a direction perpendicular to the front-rear direction.

As described above, each of the light press-fit portions 210 is brought into contact with the shell 700, the exposed portion 510 of the specific terminal 500 is brought into contact with the receiving portion 610 of the midplate 600, and the specific terminals 500 held by the holding members 200 are brought into contact with the midplate 600 by the contact pressure which is obtained by lightly press-fitting the holding members 200 into the shell 700. Accordingly, it is ideal that the light press-fit portion 210 and the corresponding exposed portion 510 are arranged on a common axis parallel to the up-down direction. However, as described above, the hole 230, which is formed upon the insert-molding, is arranged on the axis which passes through the corresponding exposed portion 510 and is parallel to the up-down direction. Thus, the light press-fit portion 210 of the present embodiment is provided at a position which neighbors to the corresponding hole 230 in the pitch direction. Considering the above, the light press-fit portion 210 is preferred to be positioned as close as possible to the axis passing through the corresponding exposed portion 510 in the pitch direction.

Figure 6:
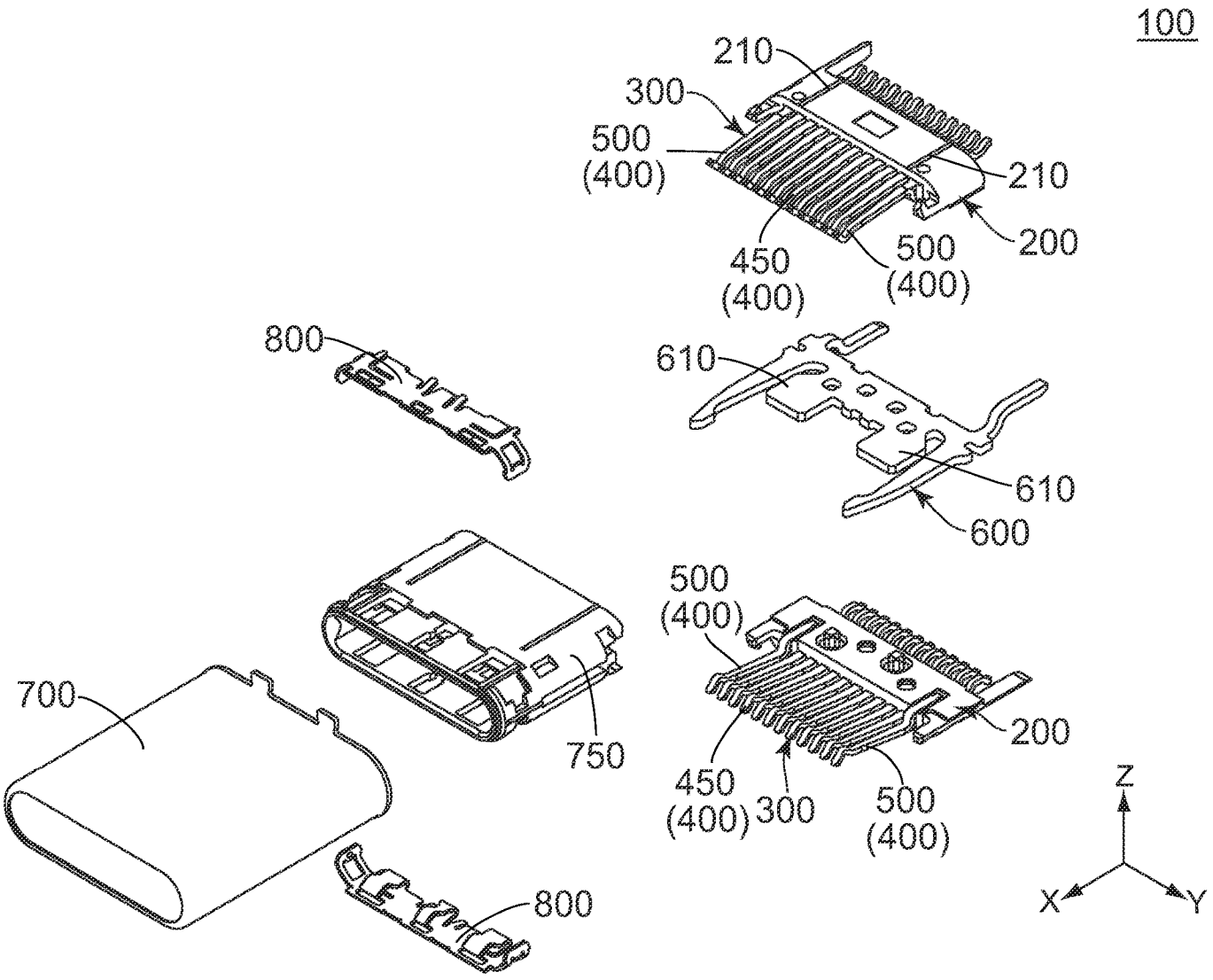
FIG. 6 is an exploded, perspective view showing the connector of FIG. 1.

As shown in FIG. 6, the connector 100 of the present embodiment comprises a front insulator 750 and two ground springs 800. Specifically, the front insulator 750 has a substantially cylindrical shape.

Referring to FIG. 5, the front insulator 750 of the present embodiment is made of resin. The front insulator 750 defines a front end of the connector 100 in the front-rear direction. The front insulator 750 is positioned forward of any of the holding members 200 in the front-rear direction. Each of the holding members 200 is directly and lightly press-fit into the shell 700 without the front insulator 750 being interposed therebetween. The front insulator 750 is held by the shell 700. Referring to FIGS. 4, 5 and 14, each of the supporting portion 453 and the contact portion 454 of the signal terminal 450 is positioned in the front insulator 750. A position of the supporting portion 453 overlaps with a position of the front insulator 750 in the front-rear direction. A position of the contact portion 454 overlaps with the position of the front insulator 750 in the front-rear direction. Each of the supporting portion 530 and the contact portion 540 of the specific terminal 500 is positioned in the front insulator 750. A position of the supporting portion 530 overlaps with the position of the front insulator 750 in the front-rear direction. A position of the contact portion 540 overlaps with the position of the front insulator 750 in the front-rear direction.

Referring to FIG. 5, each of the ground springs 800 of the present embodiment is made of metal. Each of the ground springs 800 is partially sandwiched by the shell 700 and the front insulator 750 and is partially held by the shell 700 and the front insulator 750. Each of the ground springs 800 is positioned around the front end of the connector 100 in the front-rear direction. Referring to FIGS. 4 and 5, each of the ground springs 800 is positioned forward of any of the terminal rows 300 in the front-rear direction. Each of the ground springs 800 is positioned forward of any of the signal terminals 450 in the front-rear direction. Each of the ground springs 800 is positioned forward of any of the specific terminals 500 in the front-rear direction.

Second Embodiment

Figure 19:
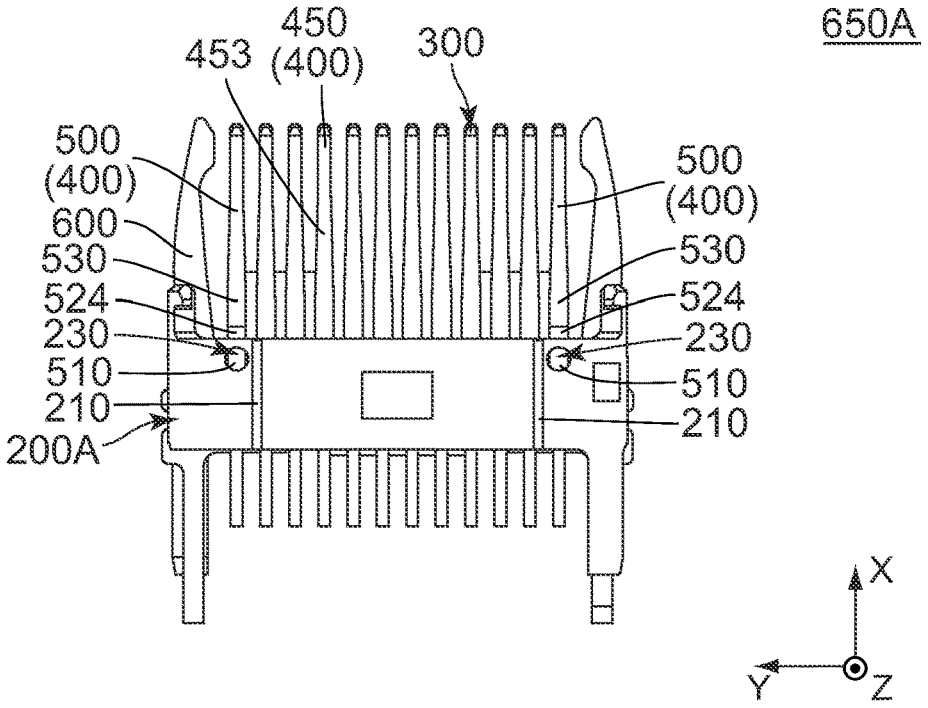
FIG. 19 is a top view showing a structural body which is included in a connector according to a second embodiment of the present invention.
Figure 20:
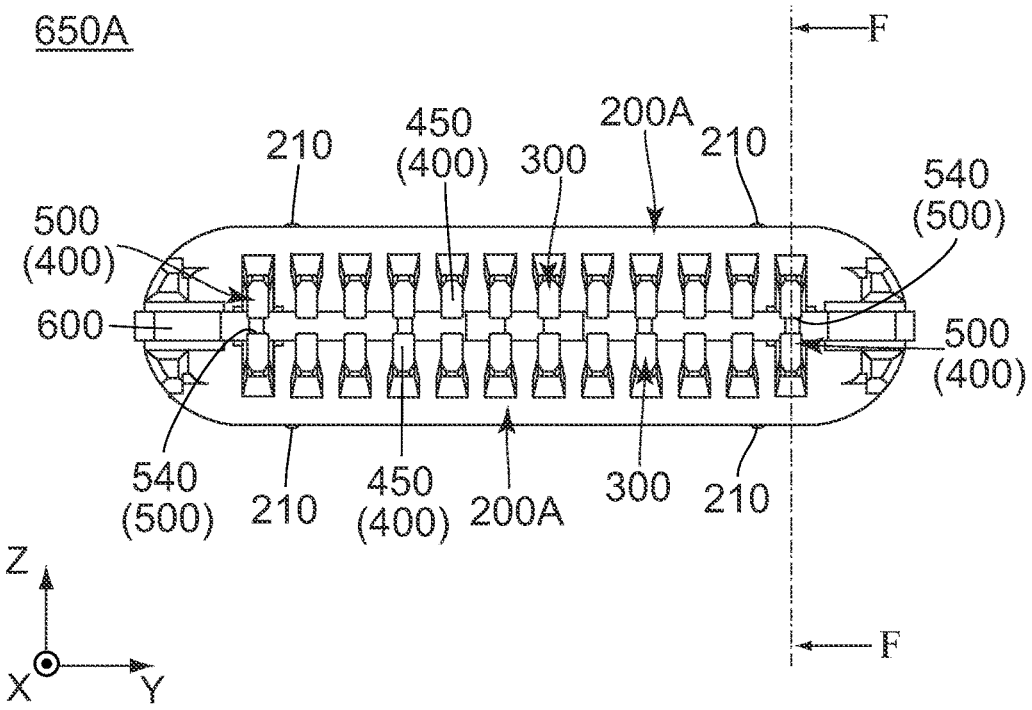
FIG. 20 is a front view showing the structural body of FIG. 19.

Referring to FIG. 19, a connector (not shown) according to a second embodiment of the present invention is a modification of the connector 100 of the first embodiment as shown in FIG. 1. Referring to FIG. 20, the connector of the present embodiment is mateable along the front-rear direction with a mating connector (not shown) which comprises mating contacts (not shown). The connector 100 of the present embodiment comprises two holding members 200A, two terminal rows 300, a midplate 600, a shell (not shown), a front insulator (not shown) and two ground springs (not shown). The two holding members 200A, the two terminal rows 300 and the midplate 600 form a structural body 650A. The connector of the present embodiment has a structure similar to that of the connector 100 according to the aforementioned first embodiment except for the holding members 200A and the structural body 650A. Components of the connector shown in FIGS. 19 to 22 which are same as those of the connector 100 of the first embodiment are referred by using reference signs same as those of the connector 100 of the first embodiment. As for directions and orientations in the present embodiment, expressions same as those of the first embodiment will be used hereinbelow.

Referring to FIG. 20, each of the holding members 200A of the present embodiment is made of resin. The holding members 200A correspond to the terminal rows 300, respectively. Each of the terminal rows 300 is held by the corresponding holding member 200A. More specifically, each of the terminal rows 300 is insert-molded in the corresponding holding member 200A. The holding members 200A are positioned away from each other in the up-down direction with the midplate 600 left therebetween in the up-down direction. Each of the holding members 200A is lightly press-fit into the shell. Each of the holding members 200A is formed with a plurality of light press-fit portions 210. More specifically, each of the holding members 200A is formed with two of the light press-fit portions 210. However, the present invention is not limited thereto. Specifically, one of the holding member 200A and the shell should be formed with at least one light press-fit portion 210. The light press-fit portion 210 of the present embodiment has a structure same as that of the light press-fit portion 210 of the first embodiment. Accordingly, detailed explanation thereabout is omitted.

Figure 21:
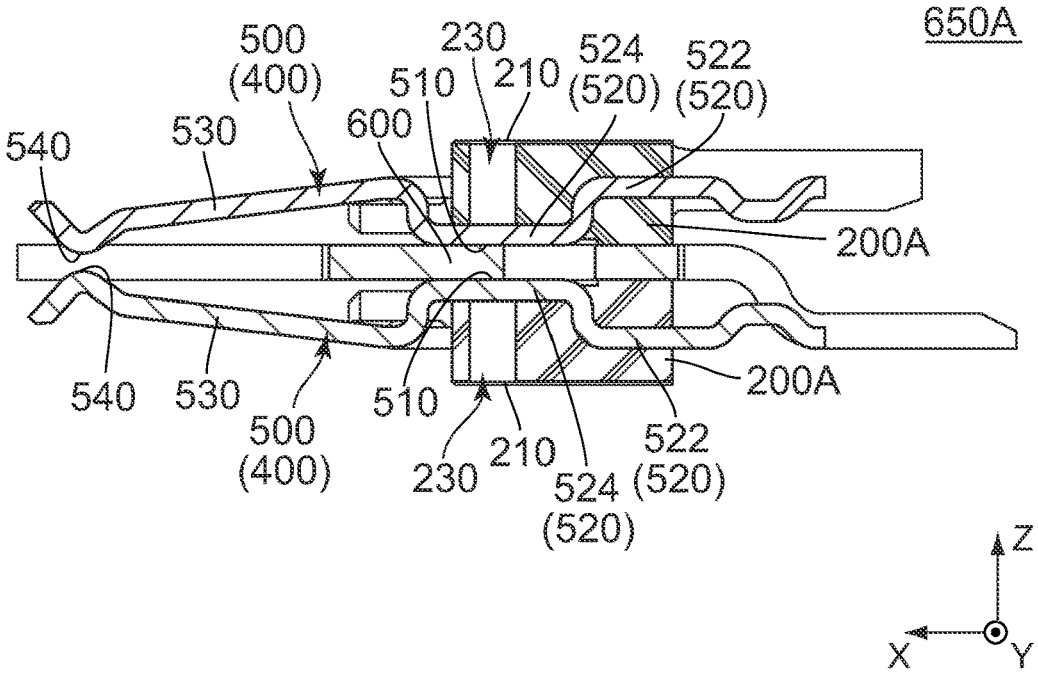
FIG. 21 is a cross-sectional view showing the structural body of FIG. 20, taken along line F-F.
Figure 22:
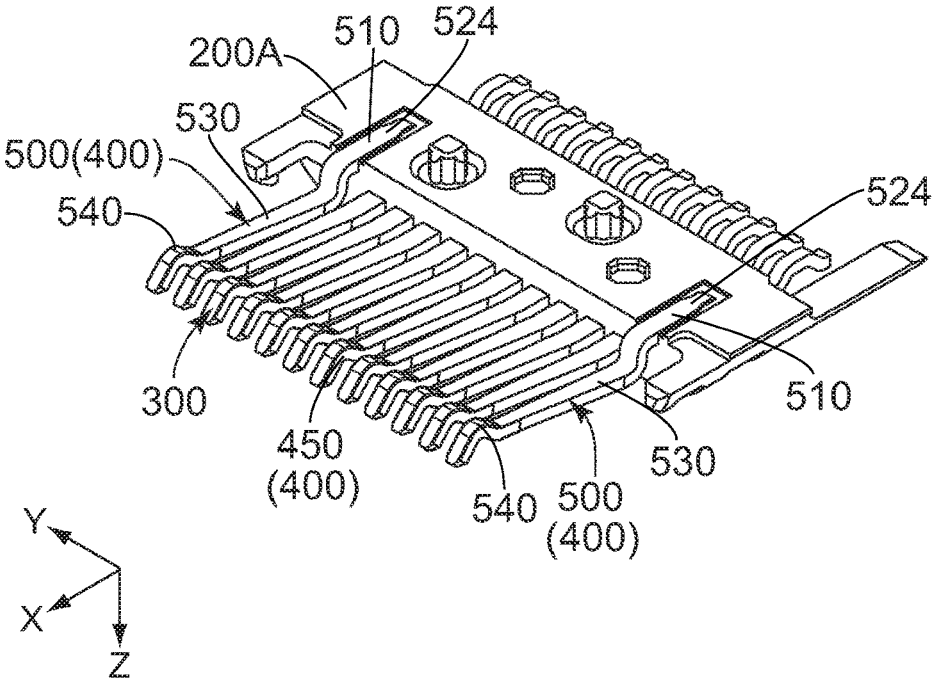
FIG. 22 is a perspective view showing a set of one of terminal rows and one of holding members, wherein the terminal rows and the holding members are included in the structural body of FIG. 19.

Referring to FIGS. 19 and 21, each of the holding members 200A of the present embodiment is formed with two holes 230. However, the present invention is not limited thereto, but the number of the hole 230 may be one. The hole 230 of the present embodiment has a structure same as that of the hole 230 of the first embodiment. Accordingly, detailed explanation thereabout is omitted.

As shown in FIG. 21, a position of the light press-fit portion 210 overlaps with a position of an exposed portion 510 of a specific terminal 500 in the front-rear direction perpendicular to both the up-down direction and the pitch direction.

As described above, each of the holding members 200A is lightly press-fit into the shell, and the position of the light press-fit portion 210 overlaps with the position of the exposed portion 510 in the front-rear direction perpendicular to both the up-down direction and the pitch direction. Accordingly, the connector of the present embodiment is configured so that the specific terminals 500, which are held by the holding members 200A, are brought into contact with the midplate 600 by a contact pressure which is obtained by lightly press-fitting the holding members 200A into the shell. This enables the connector of the present embodiment to ensure more reliable contact between each of the specific terminals 500 and the midplate 600 by its structure different from the structure of the connector 900 of Patent Document 1.

As shown in FIG. 19, when the structural body 650A is viewed from its outer side in the up-down direction, a part of a protruding portion 524 of the specific terminal 500 is not covered with the holding member 200A and is visible.

As shown in FIG. 19, a supporting portion 453 of a signal terminal 450 of the present embodiment is not held by the holding member 200A.

As shown in FIG. 21, a supporting portion 530 of the specific terminal 500 of the present embodiment is not held by the holding member 200A.

Third Embodiment

Figure 23:
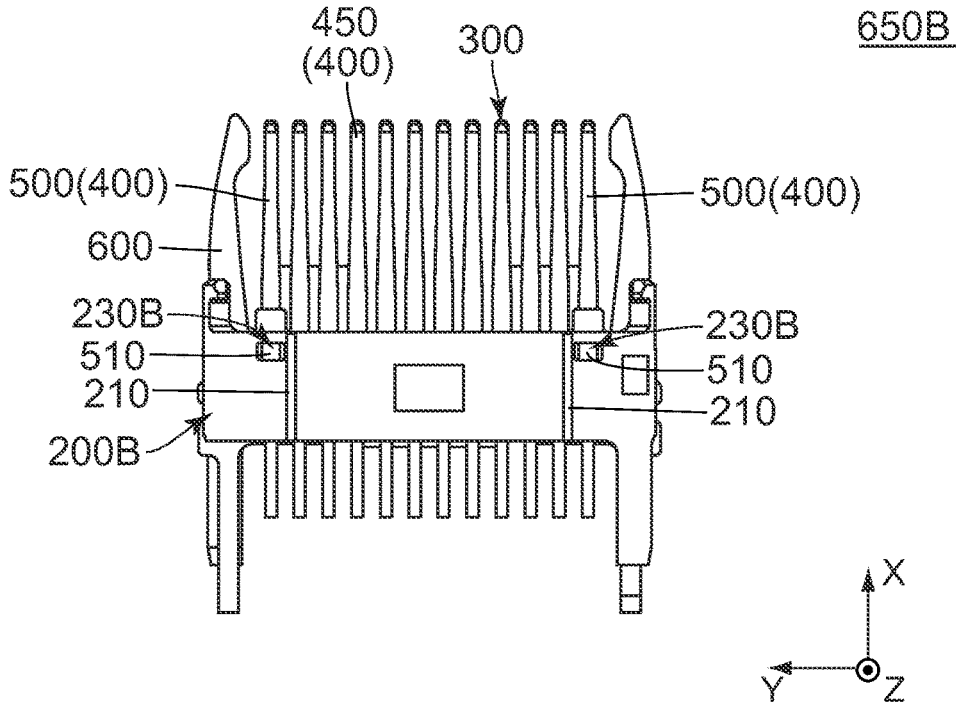
FIG. 23 is a top view showing a structural body which is included in a connector according to a third embodiment of the present invention.
Figure 24:
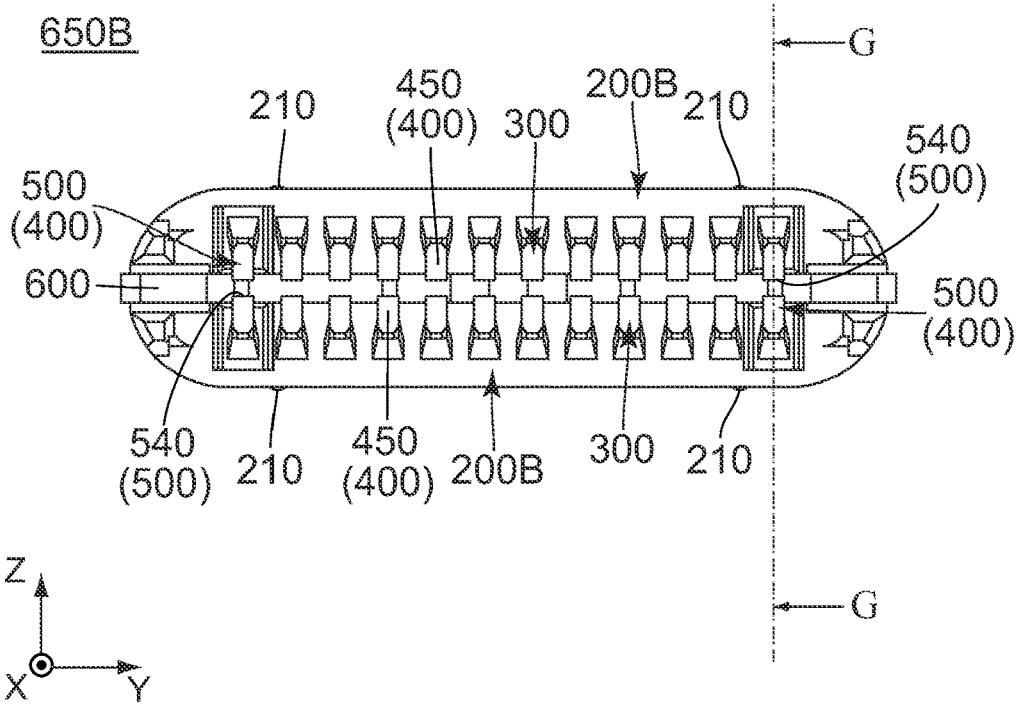
FIG. 24 is a front view showing the structural body of FIG. 23.

Referring to FIG. 23, a connector (not shown) according to a third embodiment of the present invention is a modification of the connector 100 of the first embodiment as shown in FIG. 1. Referring to FIG. 24, the connector of the present embodiment is mateable along the front-rear direction with a mating connector (not shown) which comprises mating contacts (not shown). The connector of the present embodiment comprises two holding members 200B, two terminal rows 300, a midplate 600, a shell (not shown), a front insulator (not shown) and two ground springs (not shown). The two holding members 200B, the two terminal rows 300 and the midplate 600 form a structural body 650B. The connector of the present embodiment has a structure similar to that of the connector 100 according to the aforementioned first embodiment except for the holding members 200B and the structural body 650B. Components of the connector shown in FIGS. 23 to 26 which are same as those of the connector 100 of the first embodiment are referred by using reference signs same as those of the connector 100 of the first embodiment. As for directions and orientations in the present embodiment, expressions same as those of the first embodiment will be used hereinbelow.

Referring to FIG. 24, each of the holding members 200B of the present embodiment is made of resin. The holding members 200B correspond to the terminal rows 300, respectively. Each of the terminal rows 300 is held by the corresponding holding member 200B. More specifically, each of the terminal rows 300 is insert-molded in the corresponding holding member 200B. The holding members 200B are positioned away from each other in the up-down direction with the midplate 600 left therebetween in the up-down direction. Each of the holding members 200B is lightly press-fit into the shell. Each of the holding members 200B is formed with a plurality of light press-fit portions 210. More specifically, each of the holding members 200B is formed with two of the light press-fit portions 210. However, the present invention is not limited thereto. Specifically, one of the holding member 200B and the shell should be formed with at least one light press-fit portion 210. The light press-fit portion 210 of the present embodiment has a structure same as that of the light press-fit portion 210 of the first embodiment. Accordingly, detailed explanation thereabout is omitted.

Referring to FIG. 23, each of the holding members 200B of the present embodiment is formed with two holes 230B. However, the present invention is not limited thereto, but the number of the hole 230B may be one.

Figure 25:
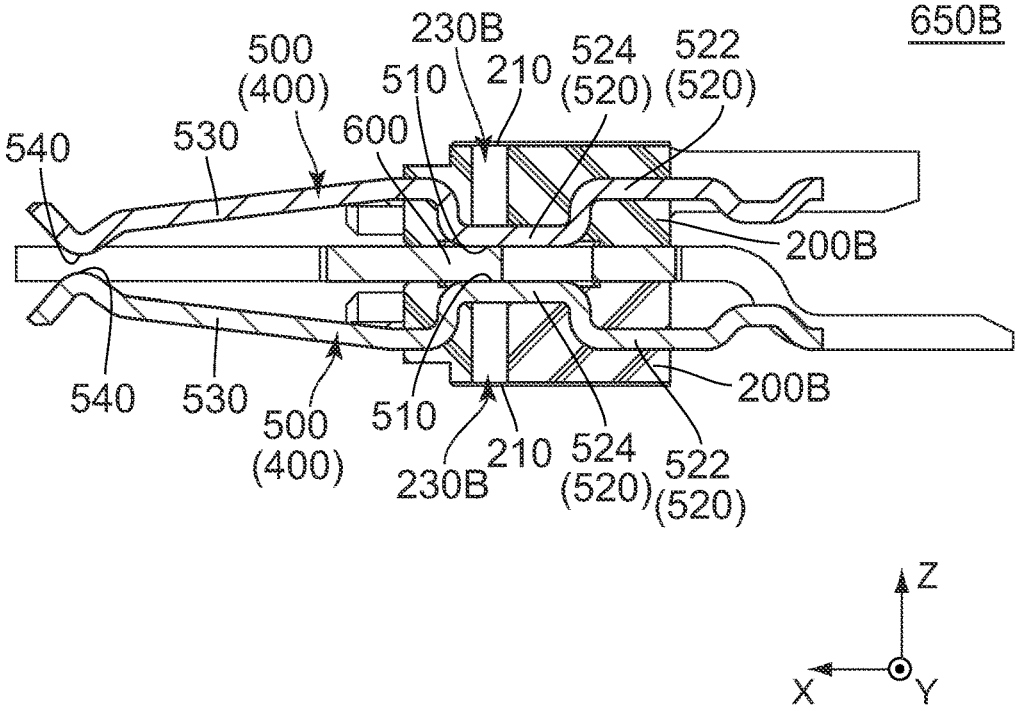
FIG. 25 is a cross-sectional view showing the structural body of FIG. 24, taken along line G-G.

Referring to FIGS. 23 and 25, each of the holes 230B of the present embodiment has a substantially rectangular cylindrical shape extending in the up-down direction. The hole 230B pierces the holding member 200B in the up-down direction. The hole 230B neighbors to the light press-fit portion 210 in the pitch direction. Specifically, the holes 230B correspond to the light press-fit portions 210, respectively, and each of the holes 230B neighbors to the corresponding light press-fit portion 210 in the pitch direction. More specifically, in the pitch direction, each of the holes 230B is positioned outward beyond the corresponding light press-fit portion 210 and neighbors to the corresponding light press-fit portion 210. In other words, each of the light press-fit portions 210 neighbors to the corresponding hole 230B in the pitch direction. More specifically, in the pitch direction, each of the light press-fit portions 210 is positioned inward beyond the corresponding hole 230B and neighbors to the corresponding hole 230.

As shown in FIG. 25, a position of the light press-fit portion 210 overlaps with a position of an exposed portion 510 of a specific terminal 500 in the front-rear direction perpendicular to both the up-down direction and the pitch direction.

As described above, each of the holding members 200B is lightly press-fit into the shell, and the position of the light press-fit portion 210 overlaps with the position of the exposed portion 510 in the front-rear direction perpendicular to both the up-down direction and the pitch direction. Accordingly, the connector of the present embodiment is configured so that the specific terminals 500, which are held by the holding members 200B, are brought into contact with the midplate 600 by a contact pressure which is obtained by lightly press-fitting the holding members 200B into the shell. This enables the connector of the present embodiment to ensure more reliable contact between each of the specific terminals 500 and the midplate 600 by its structure different from the structure of the connector 900 of Patent Document 1.

As shown in FIG. 25, a protruding portion 524 of the specific terminal 500 of the present embodiment is, at least in part, covered by the holding member 200B at any place of the protruding portion 524 in the front-rear direction. More specifically, the protruding portion 524 is covered by the holding member 200B except for the exposed portion 510. This can easily match a position of a contact portion 540 of the specific terminal 500 with a position of a contact portion 454 (see FIG. 26) of a signal terminal 450 in the up-down direction when the terminal row 300 is insert-molded in the corresponding holding member 200B.

As shown in FIG. 25, a part of a supporting portion 530 of the specific terminal 500 of the present embodiment is held by the holding member 200B. More specifically, a rear end of the supporting portion 530 and its surrounding parts are held by the holding member 200B.

Figure 26:
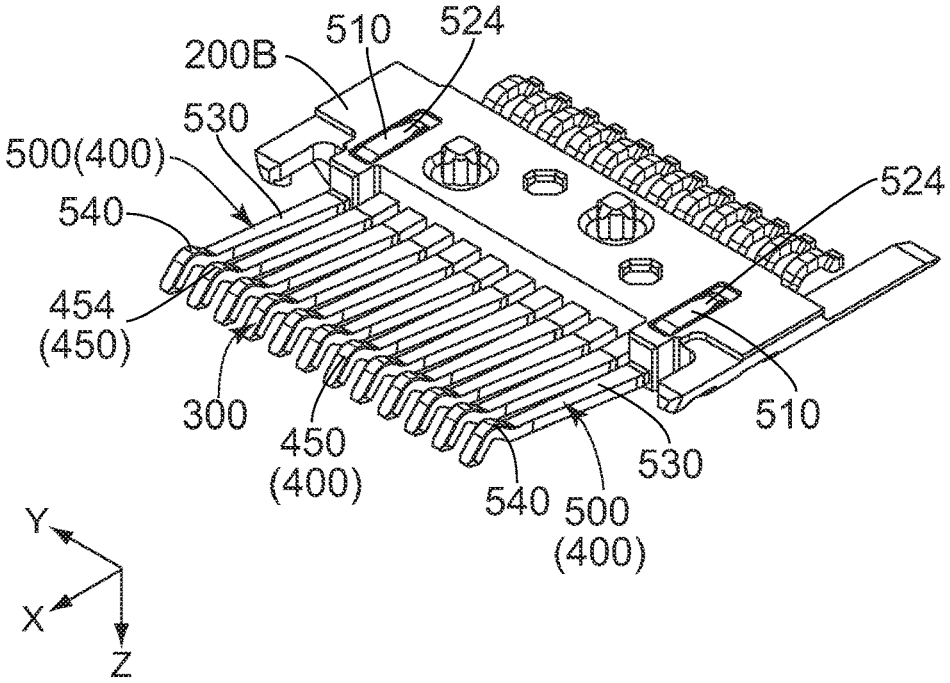
FIG. 26 is a perspective view showing a set of one of terminal rows and one of holding members, wherein the terminal rows and the holding members are included in the structural body of FIG. 23.

As understood from FIGS. 25 and 26, the rear end of the supporting portion 530 and its surrounding parts are not exposed to the outside of the holding member 200B. Thus, as compared to the first embodiment, the connector of the present embodiment can more easily match the position of the contact portion 540 of the specific terminal 500 with the position of the contact portion 454 of the signal terminal 450 in the up-down direction when the terminal row 300 is insert-molded in the corresponding holding member 200B.

Fourth Embodiment

Figure 27:
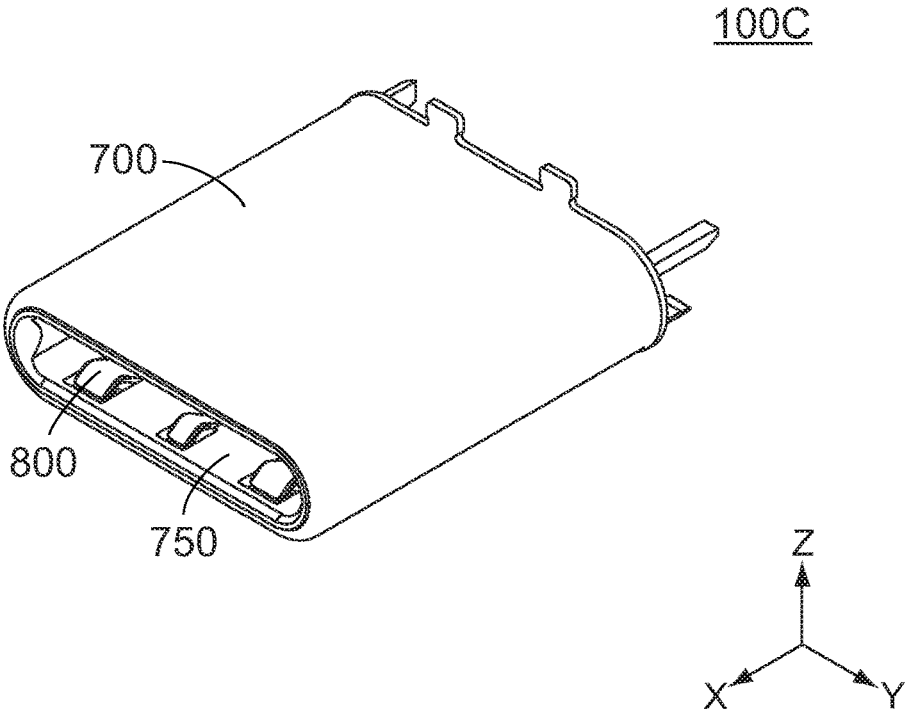
FIG. 27 is a perspective view showing a connector according to a fourth embodiment of the present invention.
Figure 28:
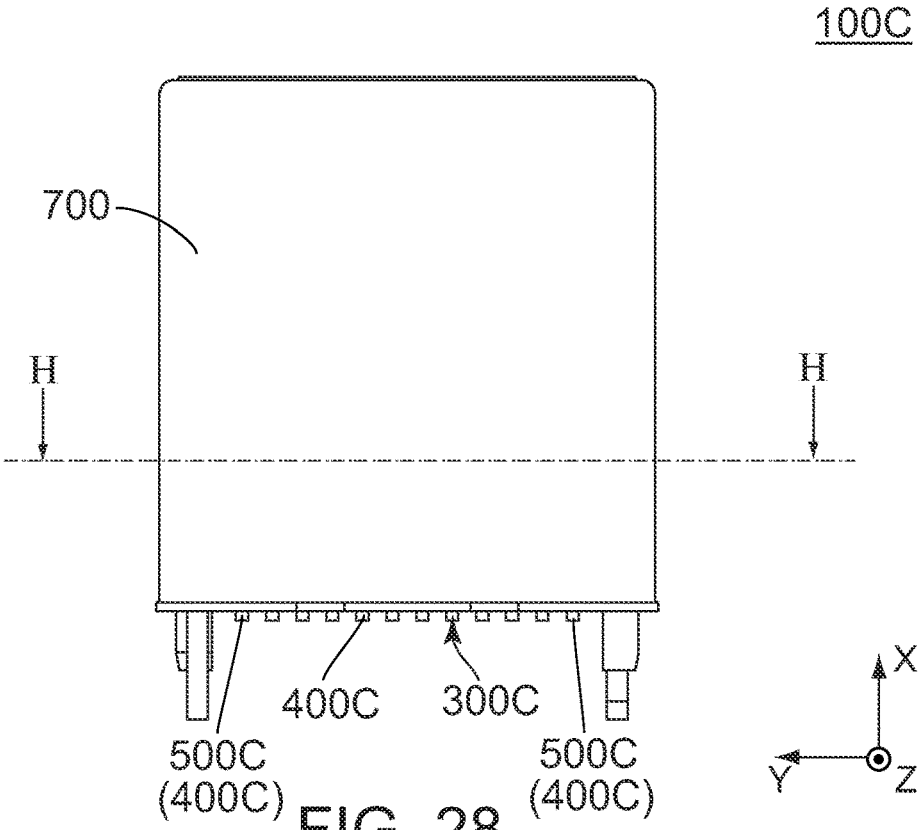
FIG. 28 is a top view showing the connector of FIG. 27.
Figure 29:
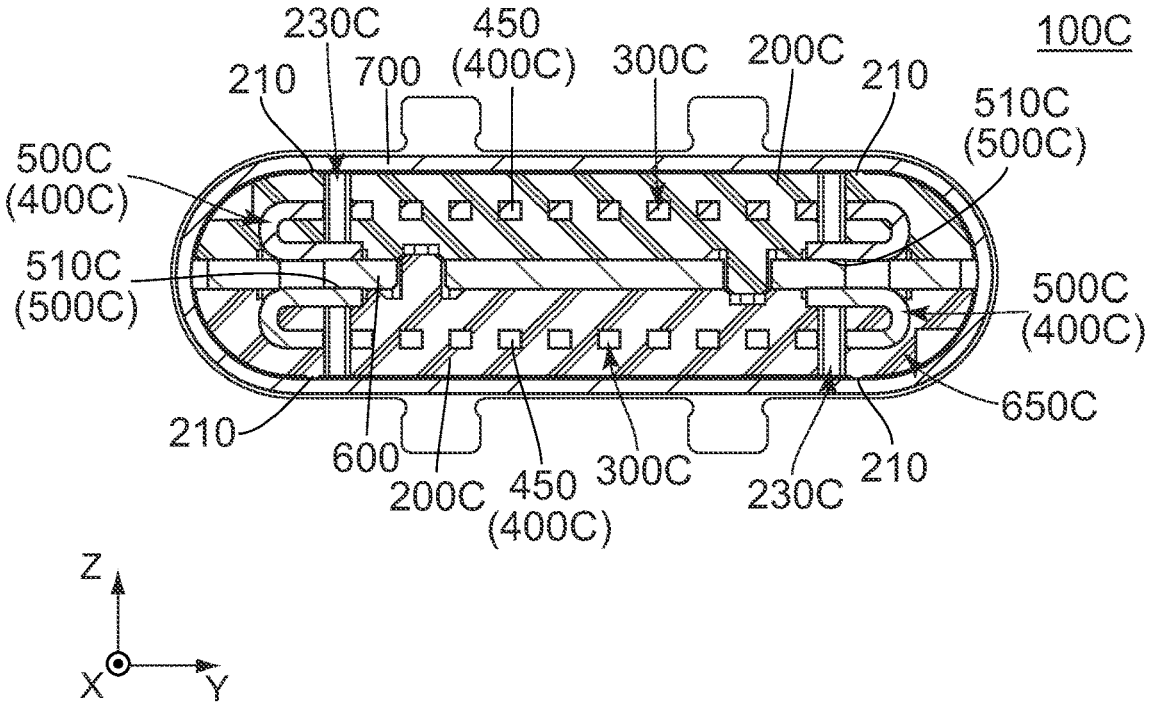
FIG. 29 is a cross-sectional view showing the connector of FIG. 28, taken along line H-H.
Figure 30:
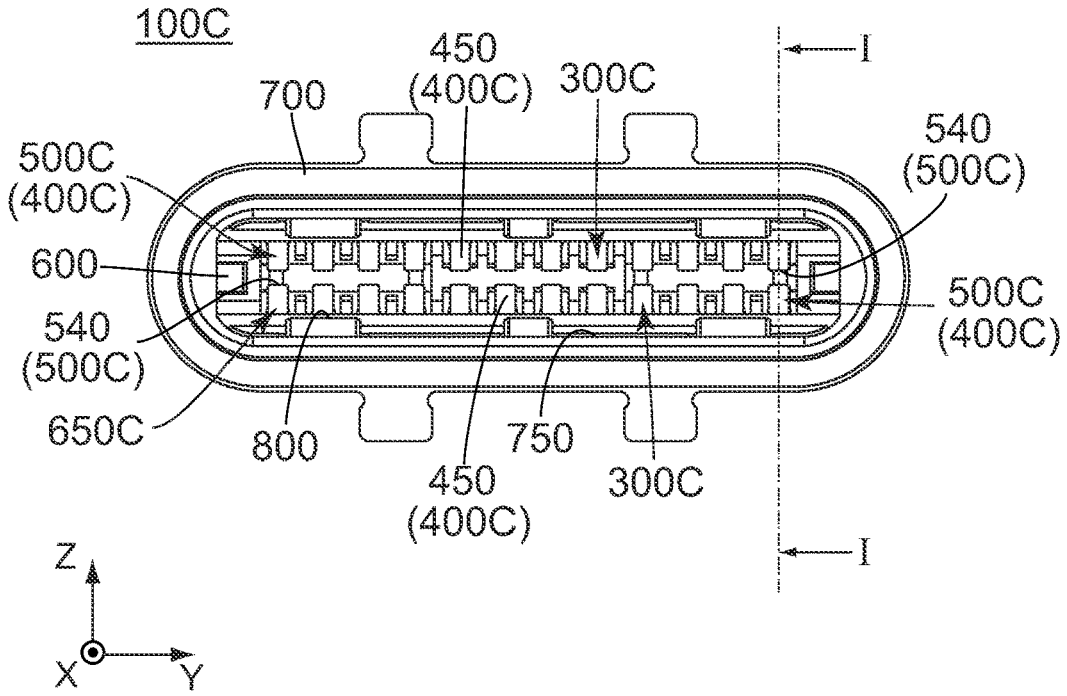
FIG. 30 is a front view showing the connector of FIG. 27.

Referring to FIG. 27, a connector 100C according to a fourth embodiment of the present invention is a modification of the connector 100 of the first embodiment as shown in FIG. 1. Referring to FIG. 30, the connector 100C of the present embodiment is mateable along the front-rear direction with a mating connector (not shown) which comprises mating contacts (not shown). As shown in FIGS. 29 and 30, the connector 100 of the present embodiment comprises two holding members 200C, two terminal rows 300C, a midplate 600, a shell 700, a front insulator 750 and two ground springs 800. The two holding members 200C, the two terminal rows 300C and the midplate 600 form a structural body 650C. The connector 100C of the present embodiment has a structure similar to that of the connector 100 according to the aforementioned first embodiment except for the holding members 200C, the terminal rows 300C and the structural body 650C. Components of the connector shown in FIGS. 27 to 37 which are same as those of the connector 100 of the first embodiment are referred by using reference signs same as those of the connector 100 of the first embodiment. As for directions and orientations in the present embodiment, expressions same as those of the first embodiment will be used hereinbelow.

Referring to FIG. 29, each of the holding members 200C of the present embodiment is made of resin. The holding members 200C correspond to the terminal rows 300C, respectively. The holding members 200C are positioned away from each other in the up-down direction with the midplate 600 left therebetween in the up-down direction. Each of the holding members 200C is lightly press-fit into the shell 700. Each of the holding members 200C is formed with a plurality of light press-fit portions 210. More specifically, each of the holding members 200C is formed with two of the light press-fit portions 210. However, the present invention is not limited thereto. Specifically, one of the holding member 200C and the shell 700 should be formed with at least one light press-fit portion 210. The light press-fit portion 210 of the present embodiment has a structure same as that of the light press-fit portion 210 of the first embodiment. Accordingly, detailed explanation thereabout is omitted.

Figure 31:
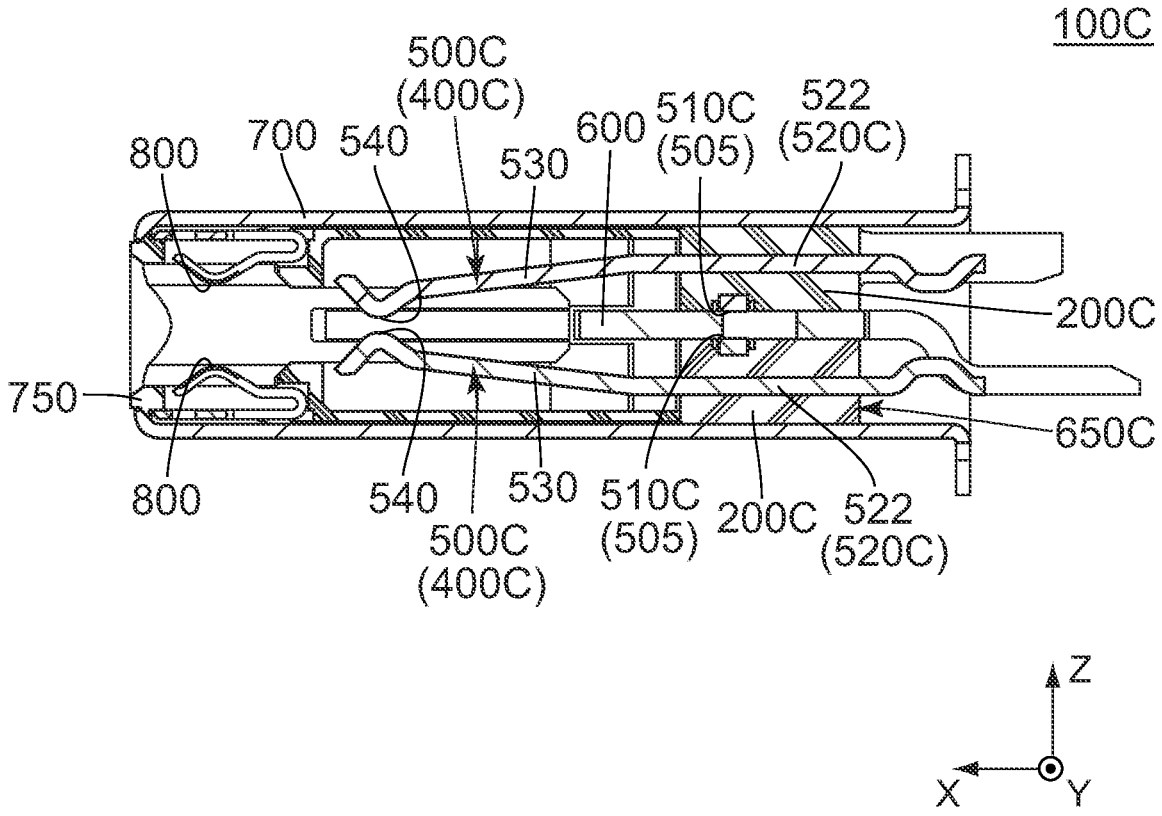
FIG. 31 is a cross-sectional view showing the connector of FIG. 30, taken along line I-I.
Figure 32:
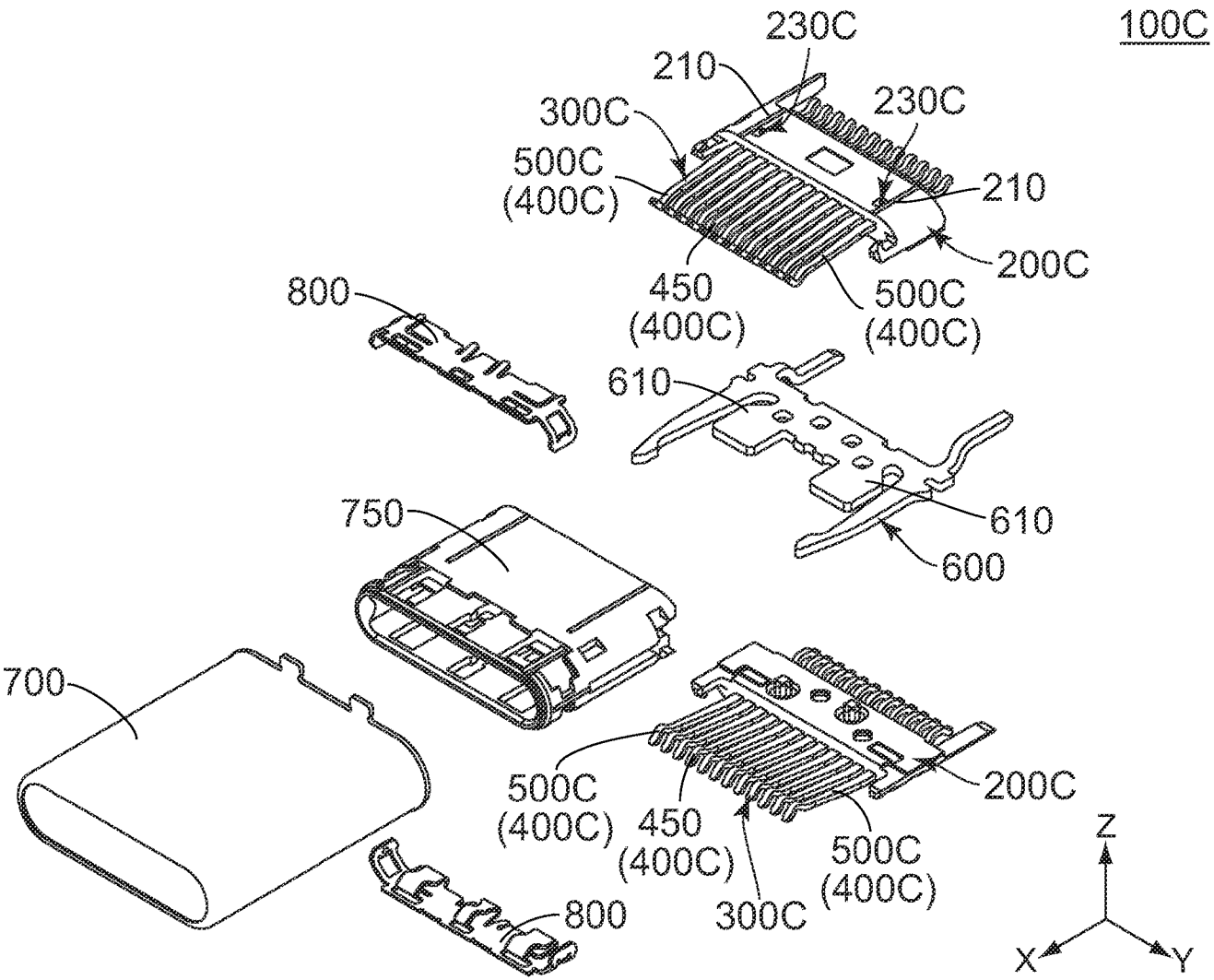
FIG. 32 is an exploded, perspective view showing the connector of FIG. 27.

Referring to FIGS. 31 and 32, each of the holding members 200C of the present embodiment is formed with two holes 230C. However, the present invention is not limited thereto, but the number of the hole 230C may be one.

Referring to FIGS. 29 and 32, each of the holes 230C of the present embodiment has a substantially rectangular cylindrical shape extending in the up-down direction. Each of the holes 230C pierces the holding member 200C in the up-down direction. The hole 230C neighbors to the light press-fit portion 210 in the pitch direction. Specifically, the holes 230C correspond to the light press-fit portions 210, respectively, and each of the holes 230C neighbors to the corresponding light press-fit portion 210 in the pitch direction. More specifically, in the pitch direction, each of the holes 230C is positioned inward beyond the corresponding light press-fit portion 210 and neighbors to the corresponding light press-fit portion 210. In other words, each of the light press-fit portions 210 neighbors to the corresponding hole 230C in the pitch direction. More specifically, in the pitch direction, each of the light press-fit portions 210 is positioned outward beyond the corresponding hole 230C and neighbors to the corresponding hole 230.

As shown in FIG. 29, the terminal rows 300C of the present embodiment are positioned away from each other in the up-down direction with the midplate 600 left therebetween in the up-down direction. Each of the terminal rows 300C is held by the corresponding holding member 200C. More specifically, each of the terminal rows 300C is insert-molded in the corresponding holding member 200C. Each of the terminal rows 300C has a plurality of terminals 400C.

Figure 33:
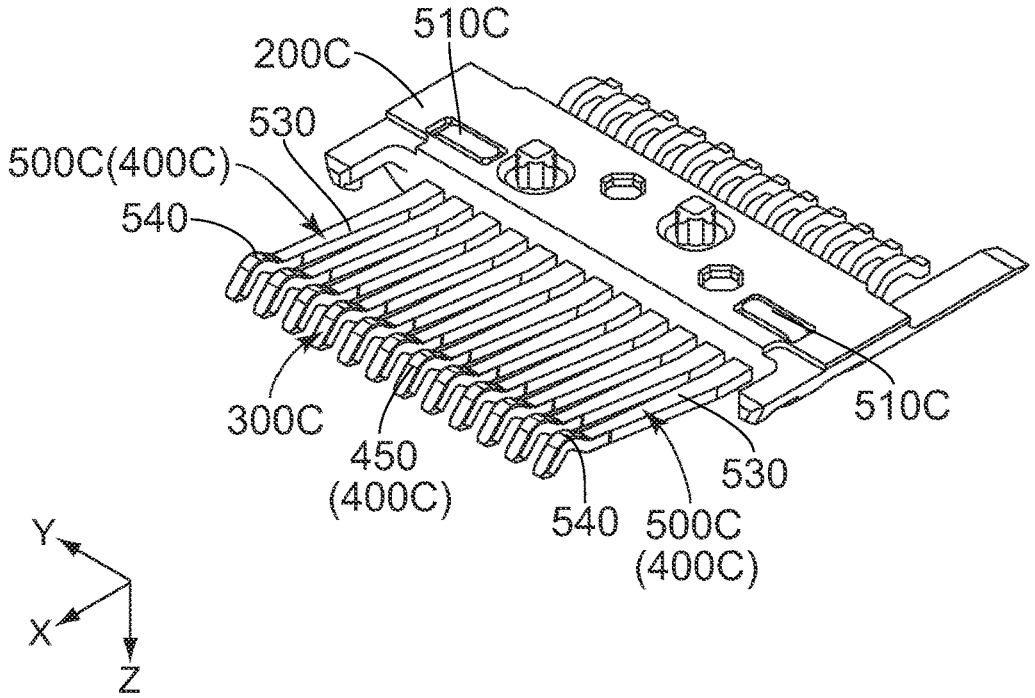
FIG. 33 is a perspective view showing a set of one of terminal rows and one of holding members, wherein the terminal rows and the holding members are included in the connector of FIG. 32.

Referring to FIG. 33, each of the terminals 400C of the present embodiment is made of metal. In each terminal row 300C, the terminals 400C are arranged in the pitch direction. The terminals 400C of each of the terminal rows 300C include a plurality of signal terminals 450 and two specific terminals 500C. However, the present invention is not limited thereto. Specifically, the terminals 400C of each of the terminal rows 300C should include at least one specific terminal 500C. The signal terminal 450 of the present embodiment has a structure same as that of the signal terminal 450 of the first embodiment. Accordingly, detailed explanation thereabout is omitted.

As shown in FIG. 33, each of the specific terminals 500C of the present embodiment has an exposed portion 510C.

As shown in FIG. 33, the exposed portion 510C of the present embodiment has a plate-like shape intersecting with the up-down direction. More specifically, the exposed portion 510C is perpendicular to the up-down direction. The exposed portion 510C is exposed from the holding member 200C in the up-down direction. However, the present invention is not limited thereto. Specifically, the exposed portion 510C should be, at least in part, exposed from the holding member 200C in the up-down direction perpendicular to the pitch direction. As understood from FIGS. 29, 31 and 32, a position of the light press-fit portion 210 overlaps with a position of the exposed portion 510C in the front-rear direction perpendicular to both the up-down direction and the pitch direction.

As described above, each of the holding members 200C is lightly press-fit into the shell 700, and the position of the light press-fit portion 210 overlaps with the position of the exposed portion 510C in the front-rear direction perpendicular to both the up-down direction and the pitch direction. Accordingly, the connector 100C of the present embodiment is configured so that the specific terminals 500C, which are held by the holding members 200C, are brought into contact with the midplate 600 by a contact pressure which is obtained by lightly press-fitting the holding members 200C into the shell 700. This enables the connector 100C of the present embodiment to ensure more reliable contact between each of the specific terminals 500C and the midplate 600 by its structure different from the connector 900 of Patent Document 1.

Figure 36:
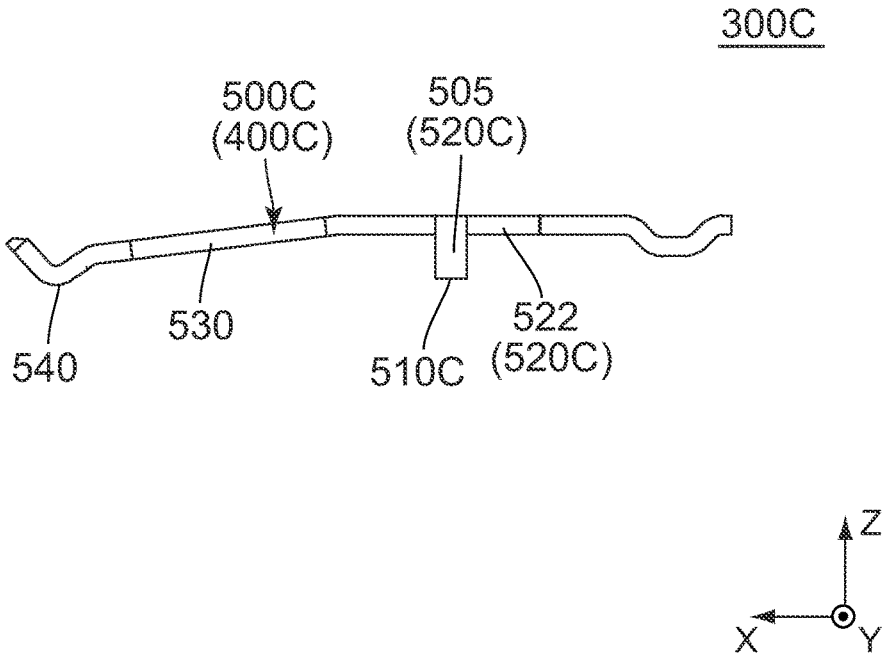
FIG. 36 is a side view showing the terminal row of FIG. 34.

As shown in FIG. 36, the specific terminal 500C of the present embodiment has a held portion 520C, a supporting portion 530 and a contact portion 540. The supporting portion 530 and the contact portion 540 of the present embodiment have structures same as those of the supporting portion 530 and the contact portion 540 of the first embodiment. Accordingly, detailed explanation thereabout is omitted.

As shown in FIG. 36, the held portion 520C of the present embodiment is positioned rearward of the supporting portion 530 in the front-rear direction. As shown in FIG. 31, the held portion 520C is, at least in part, held by the holding member 200C. The exposed portion 510C is formed on the held portion 520C. The held portion 520C has an embedded portion 522 and a bent portion 505.

As shown in FIG. 36, the embedded portion 522 of the present embodiment is positioned rearward of the bent portion 505 in the front-rear direction. The embedded portion 522 is positioned rearward of the exposed portion 510C in the front-rear direction. The embedded portion 522 is positioned outward beyond the exposed portion 510C in the up-down direction. As shown in FIG. 31, the embedded portion 522 is embedded in the holding member 200C.

Figure 34:
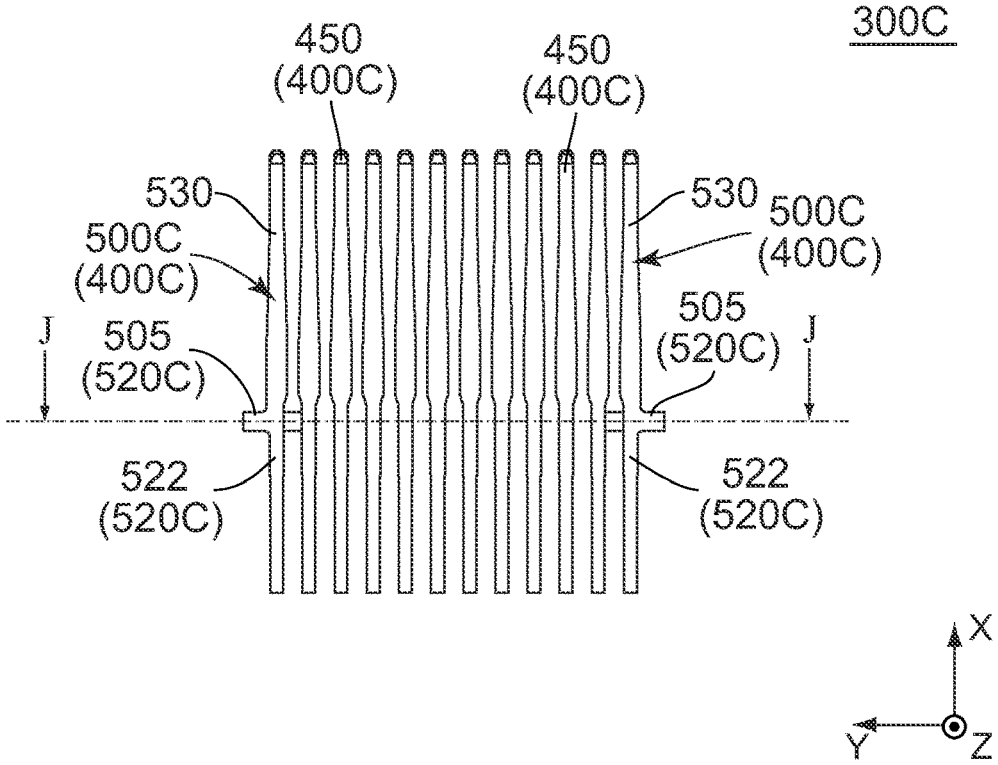
FIG. 34 is a top view showing a terminal row which is included in the connector of FIG. 32.
Figure 35:
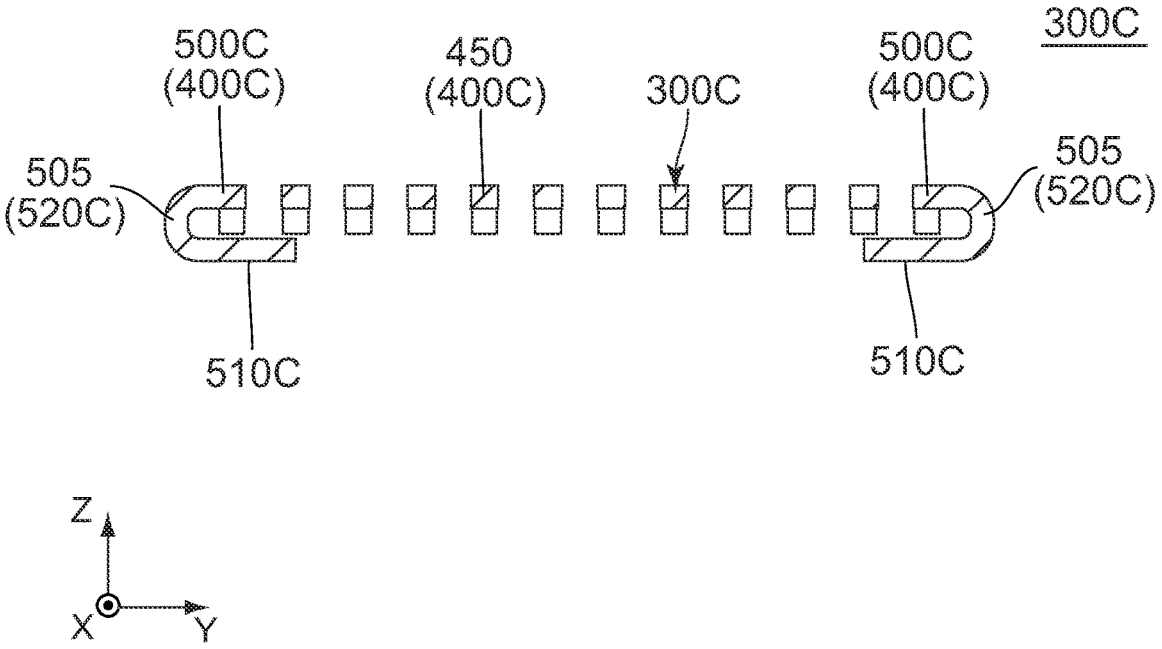
FIG. 35 is a cross-sectional view showing the terminal row of FIG. 34, taken along line J-J.
Figure 37:
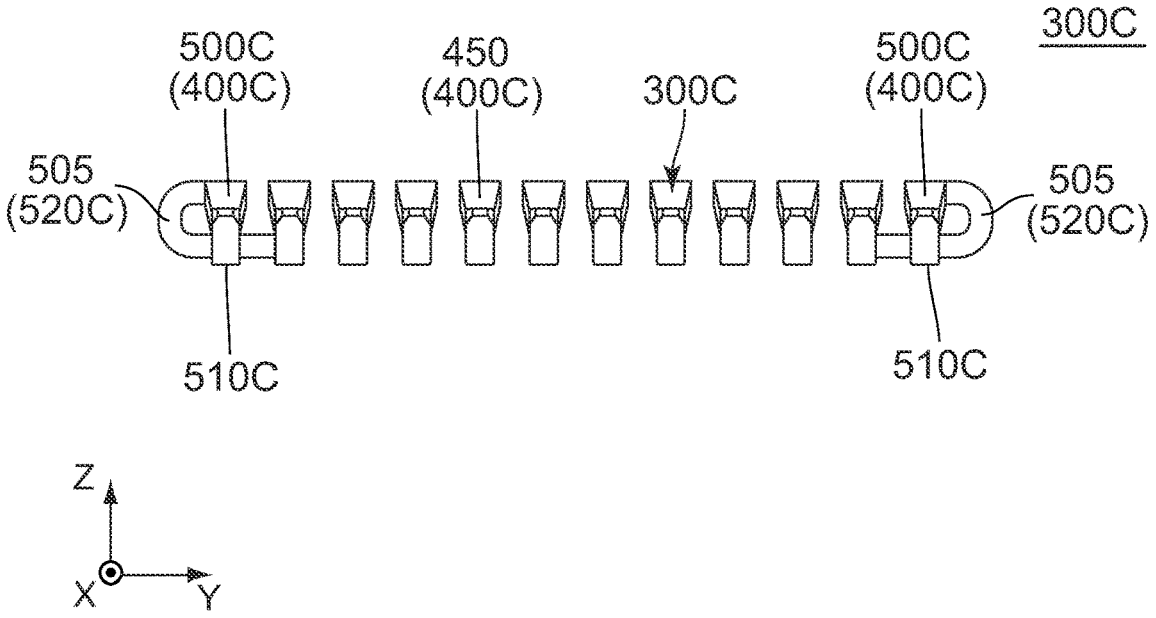
FIG. 37 is a front view showing the terminal row of FIG. 34.

Referring to FIGS. 34 and 37, the bent portion 505 extends outward in the pitch direction from the embedded portion 522 and is curved to protrude outward in the pitch direction and then extends inward in the pitch direction. As shown in FIG. 35, the bent portion 505 has a sideways U cross-section in a plane perpendicular to the front-rear direction. The exposed portion 510C is provided on the bent portion 505. The exposed portion 510C defines an inner end of the bent portion 505 in the up-down direction.

Fifth Embodiment

Figure 38:
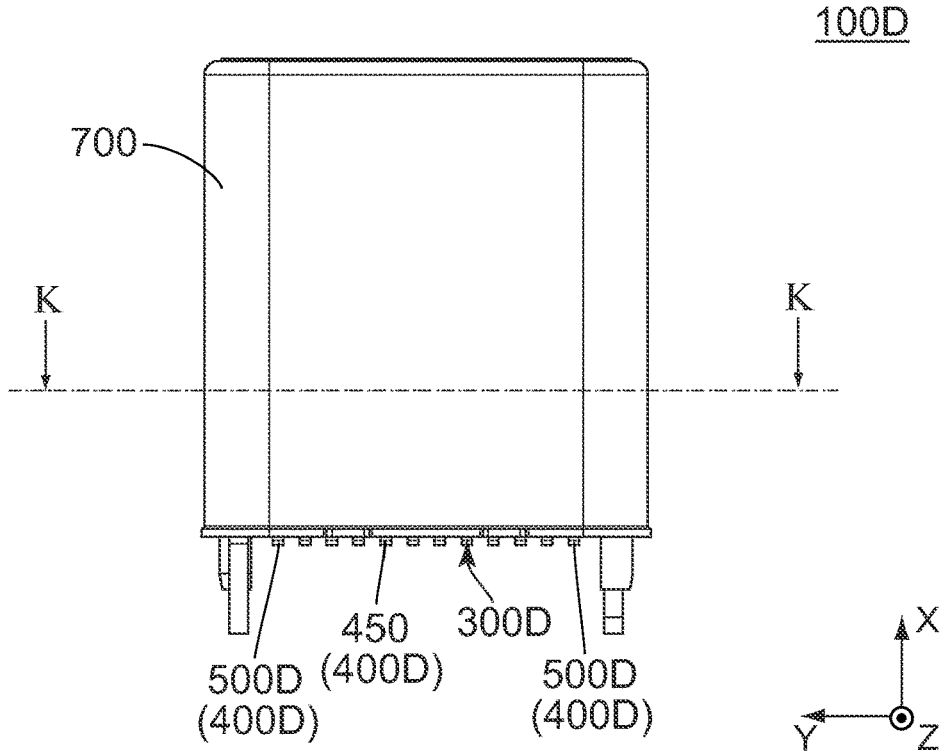
FIG. 38 is a top view showing a connector according to a fifth embodiment of the present invention.
Figure 39:
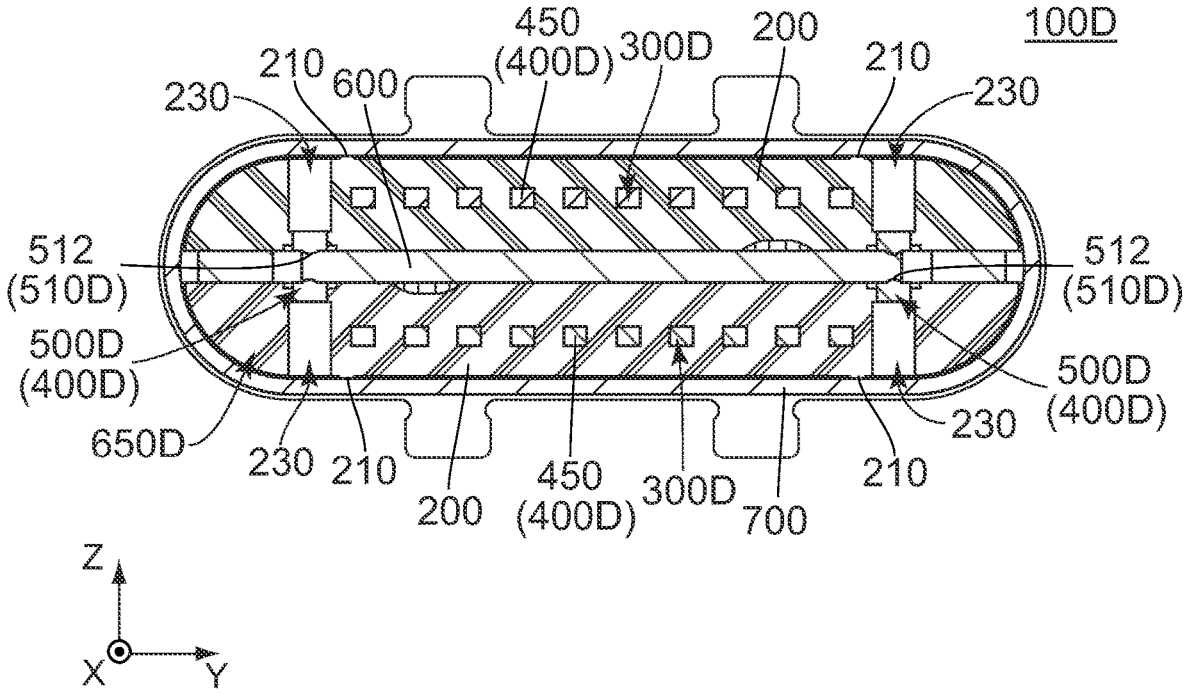
FIG. 39 is a cross-sectional view showing the connector of FIG. 38, taken along line K-K.
Figure 40:
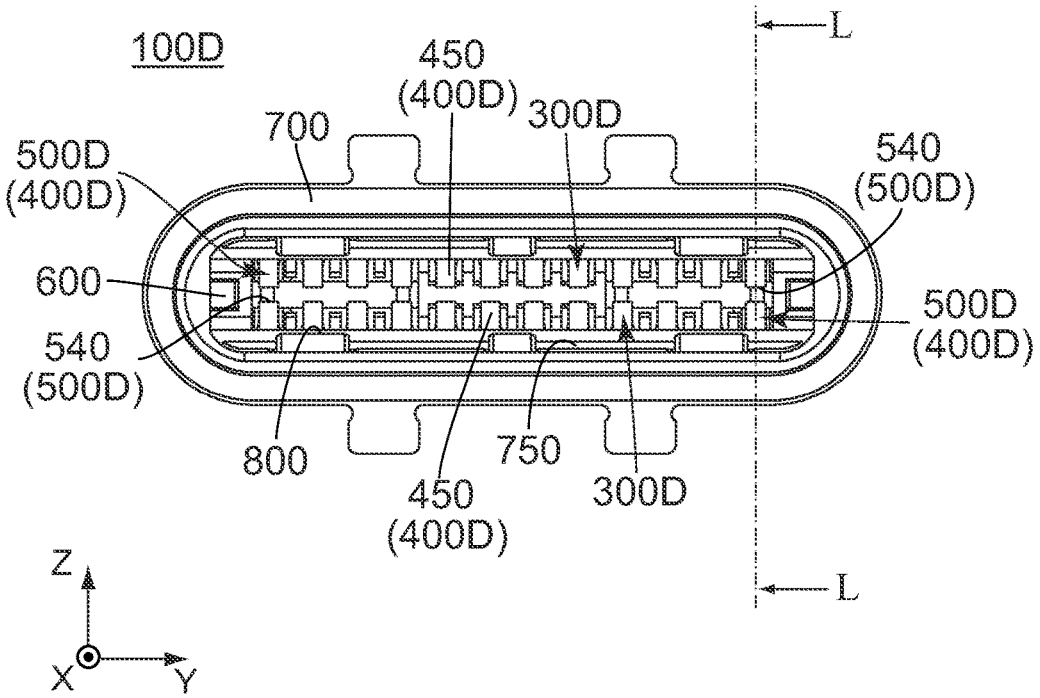
FIG. 40 is a front view showing the connector of FIG. 38.

Referring to FIG. 38, a connector 100D according to a fifth embodiment of the present invention is a modification of the connector 100 of the first embodiment as shown in FIG. 1. Referring to FIG. 40, the connector 100D of the present embodiment is mateable along the front-rear direction with a mating connector (not shown) which comprises mating contacts (not shown). As shown in FIGS. 39 and 40, the connector 100D of the present embodiment comprises two holding members 200, two terminal rows 300D, a midplate 600, a shell 700, a front insulator 750 and two ground springs 800. The two holding members 200, the two terminal rows 300D and the midplate 600 form a structural body 650D. The connector 100D of the present embodiment has a structure similar to that of the connector 100 according to the aforementioned first embodiment except for the terminal rows 300D and the structural body 650D. Components of the connector shown in FIGS. 38 to 46 which are same as those of the connector 100 of the first embodiment are referred by using reference signs same as those of the connector 100 of the first embodiment. As for directions and orientations in the present embodiment, expressions same as those of the first embodiment will be used hereinbelow.

As shown in FIG. 39, the terminal rows 300D of the present embodiment are positioned away from each other in the up-down direction with the midplate 600 left therebetween in the up-down direction. The holding members 200 correspond to the terminal rows 300D, respectively. Each of the terminal rows 300D is held by the corresponding holding member 200. More specifically, each of the terminal rows 300D is insert-molded in the corresponding holding member 200. Each of the terminal rows 300D has a plurality of terminals 400D.

Figure 46:
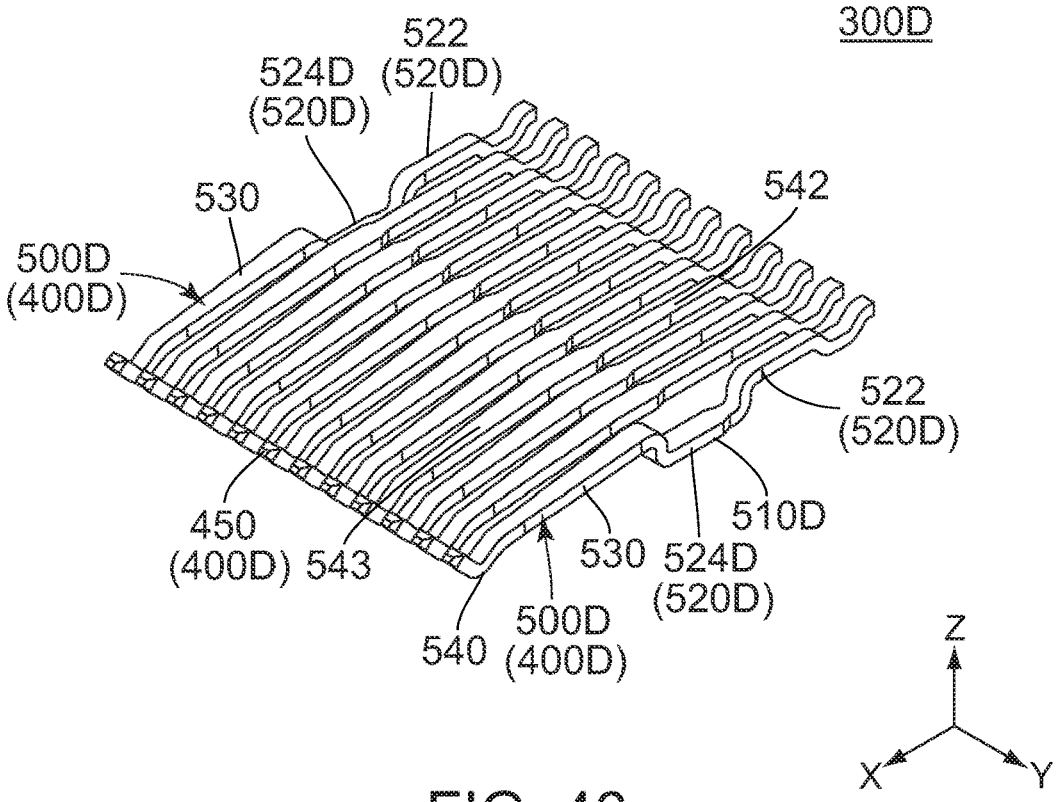
FIG. 46 is a perspective view showing a terminal row which is included in the connector of FIG. 38.

Referring to FIG. 46, each of the terminals 400D of the present embodiment is made of metal. In each terminal row 300D, the terminals 400D are arranged in the pitch direction. The terminals 400D of each of the terminal rows 300D include a plurality of signal terminals 450 and two specific terminals 500D. However, the present invention is not limited thereto. Specifically, the terminals 400D of each of the terminal rows 300D should include at least one specific terminal 500D. The signal terminal 450 of the present embodiment has a structure same as that of the signal terminal 450 of the first embodiment. Accordingly, detailed explanation thereabout is omitted.

Figure 43:
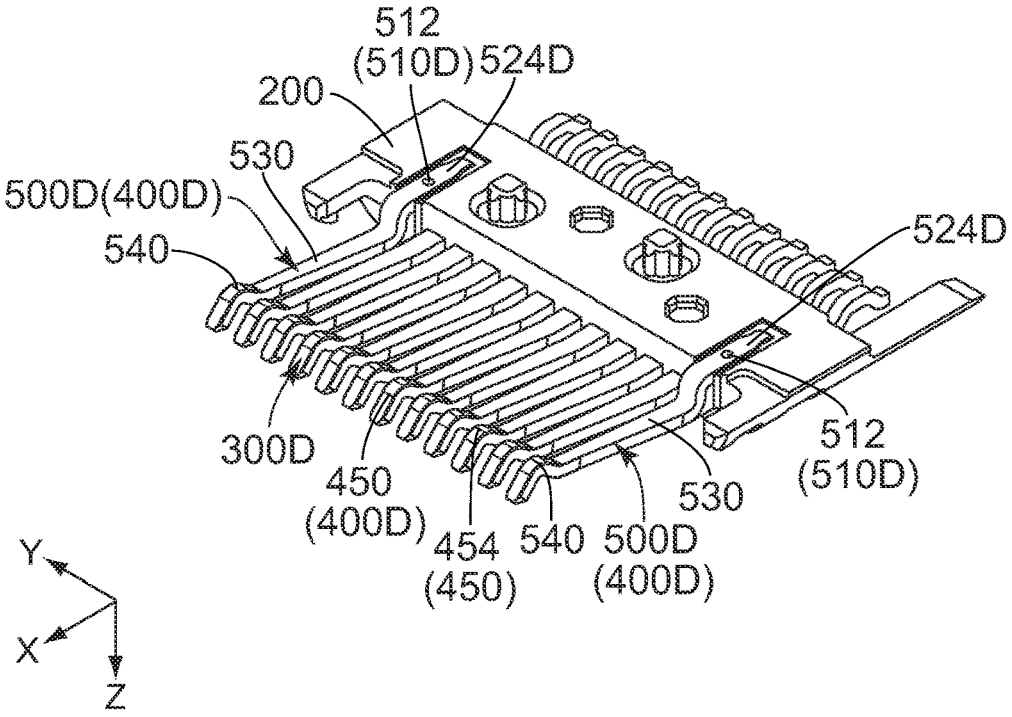
FIG. 43 is a perspective view showing the set of the terminal row and the holding member of FIG. 42.
Figure 44:
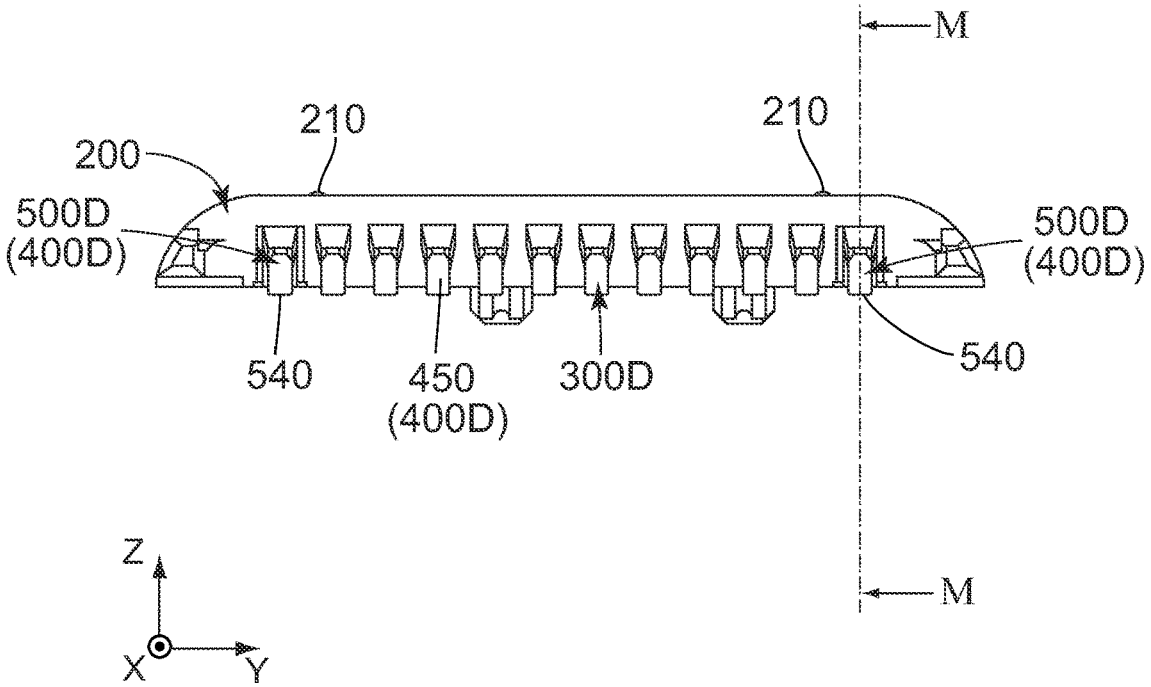
FIG. 44 is a front view showing the set of the terminal row and the holding member of FIG. 42.

As shown in FIG. 43, each of the specific terminals 500D of the present embodiment has an exposed portion 510D.

As shown in FIG. 43, the exposed portion 510D of the present embodiment has a plate-like shape intersecting with the up-down direction. More specifically, the exposed portion 510D is perpendicular to the up-down direction. The exposed portion 510D is exposed from the holding member 200 in the up-down direction. However, the present invention is not limited thereto. Specifically, the exposed portion 510D should be, at least in part, exposed from the holding member 200 in the up-down direction perpendicular to the pitch direction. As understood from FIGS. 39, 41 and 42, a position of the light press-fit portion 210 overlaps with a position of the exposed portion 510D in the front-rear direction perpendicular to both the up-down direction and the pitch direction.

Figure 41:
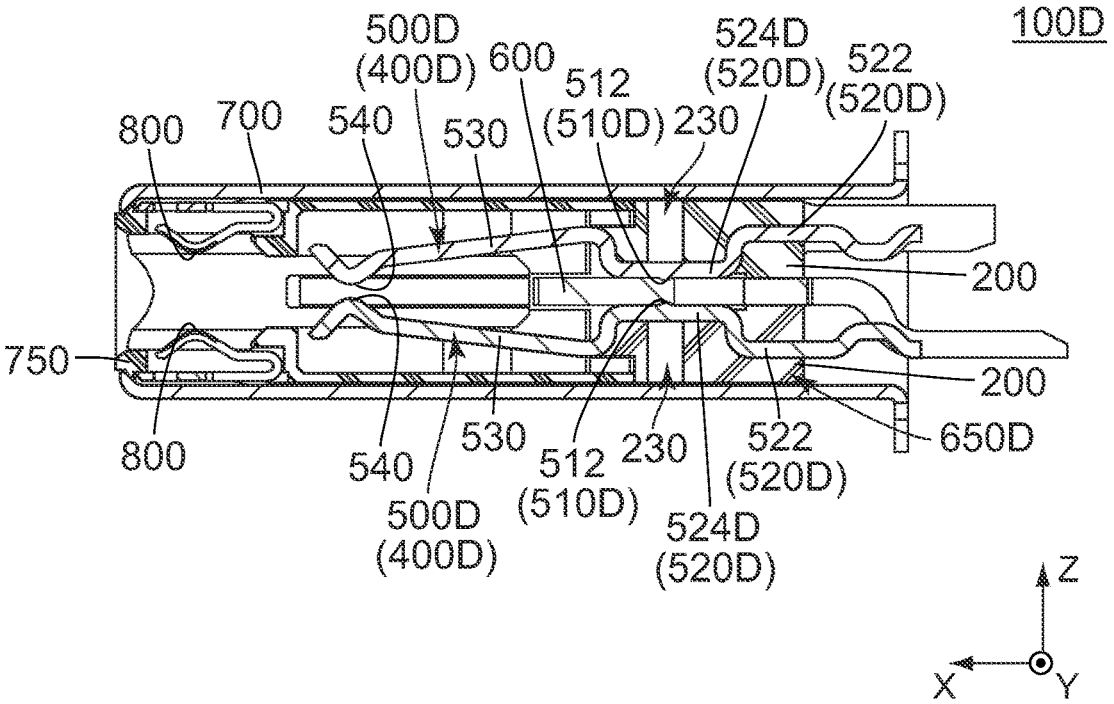
FIG. 41 is a cross-sectional view showing the connector of FIG. 40, taken along line L-L.
Figure 42:
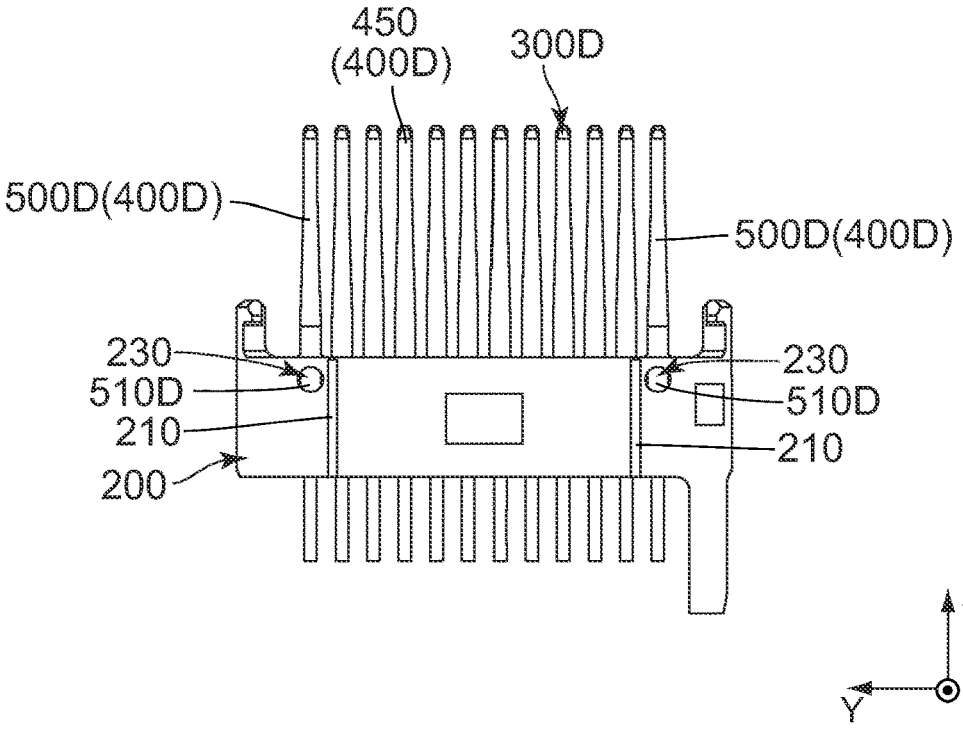
FIG. 42 is a top view showing a set of one of terminal rows and one of holding members, wherein the terminal rows and the holding members are included in the connector of FIG. 38.

As shown in FIG. 43, the exposed portion 510D is provided with a protrusion 512. As shown in FIG. 41, the protrusion 512 protrudes inward in the up-down direction. The protrusion 512 is pressed against the midplate 600. As understood from FIGS. 39, 41 and 42, the position of the light press-fit portion 210 overlaps with a position of the protrusion 512 in the front-rear direction perpendicular to both the up-down direction and the pitch direction.

As described above, each of the holding members 200 is lightly press-fit into the shell 700, and the position of the light press-fit portion 210 overlaps with the position of the protrusion 512 in the front-rear direction perpendicular to both the up-down direction and the pitch direction. Accordingly, the connector 100D of the present embodiment is configured so that the specific terminals 500D, which are held by the holding members 200, are brought into contact with the midplate 600 by a contact pressure which is obtained by lightly press-fitting the holding members 200 into the shell 700. This enables the connector 100D of the present embodiment to ensure more reliable contact between each of the specific terminals 500D and the midplate 600 by its structure different from the structure of the connector 900 of Patent Document 1.

As shown in FIG. 46, the specific terminal 500D of the present embodiment has a held portion 520D, a supporting portion 530 and a contact portion 540. The supporting portion 530 and the contact portion 540 of the present embodiment have structures same as those of the supporting portion 530 and the contact portion 540 of the first embodiment. Accordingly, detailed explanation thereabout is omitted.

Figure 45:
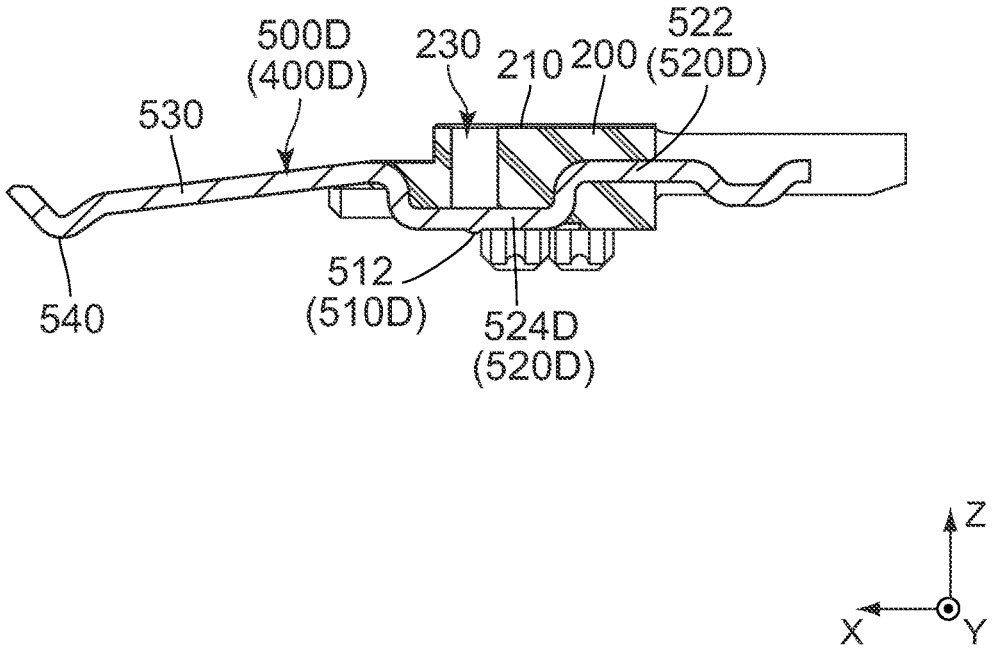
FIG. 45 is a cross-sectional view showing the set of the terminal row and the holding member of FIG. 44, taken along line M-M.

As shown in FIG. 45, the held portion 520D of the present embodiment is positioned rearward of the supporting portion 530 in the front-rear direction. The held portion 520CD is, at least in part, held by the holding member 200. The exposed portion 510D is formed on the held portion 520D. The held portion 520D has an embedded portion 522 and a protruding portion 524D. The exposed portion 510D is positioned between the contact portion 540 and the embedded portion 522 in the front-rear direction. The exposed portion 510D is positioned between the supporting portion 530 and the embedded portion 522 in the front-rear direction. The embedded portion 522 of the present embodiment has a structure same as the embedded portion 522 of the first embodiment. Accordingly, detailed explanation thereabout is omitted.

As shown in FIG. 41, the protruding portion 524D of the present embodiment is positioned forward of the embedded portion 522 in the front-rear direction. The protruding portion 524D protrudes toward the midplate 600 beyond any of the embedded portion 522 and the supporting portion 530. The protruding portion 524D is positioned between the contact portion 540 and the embedded portion 522 in the front-rear direction. The protruding portion 524D is positioned between the supporting portion 530 and the embedded portion 522 in the front-rear direction. The supporting portion 530 extends forward in the front-rear direction from the protruding portion 524D. The exposed portion 510D is provided on the protruding portion 524D.

Sixth Embodiment

Figure 47:
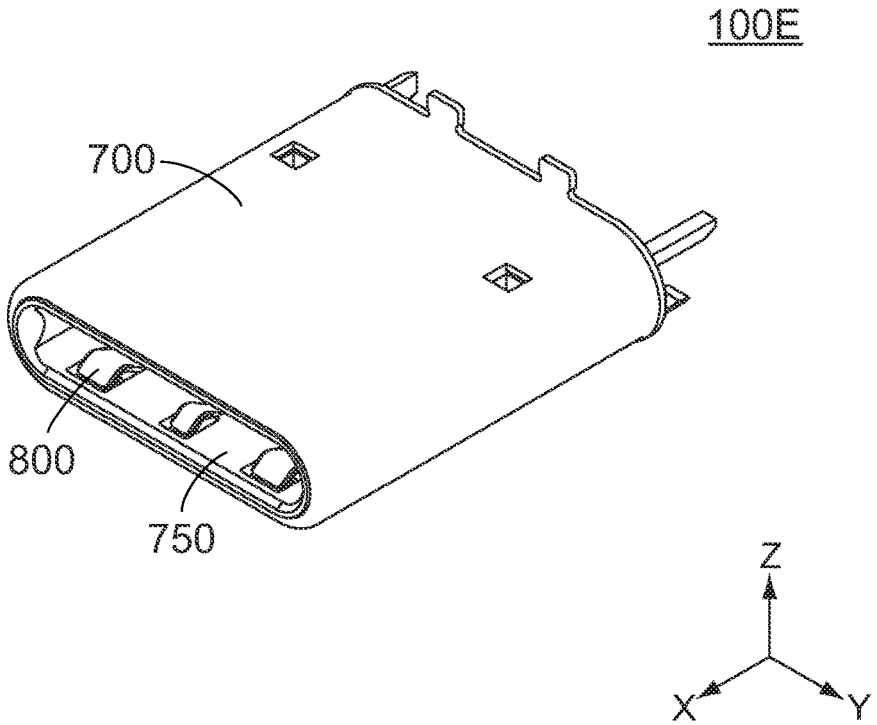
FIG. 47 is a perspective view showing a connector according to a sixth embodiment of the present invention.
Figure 48:
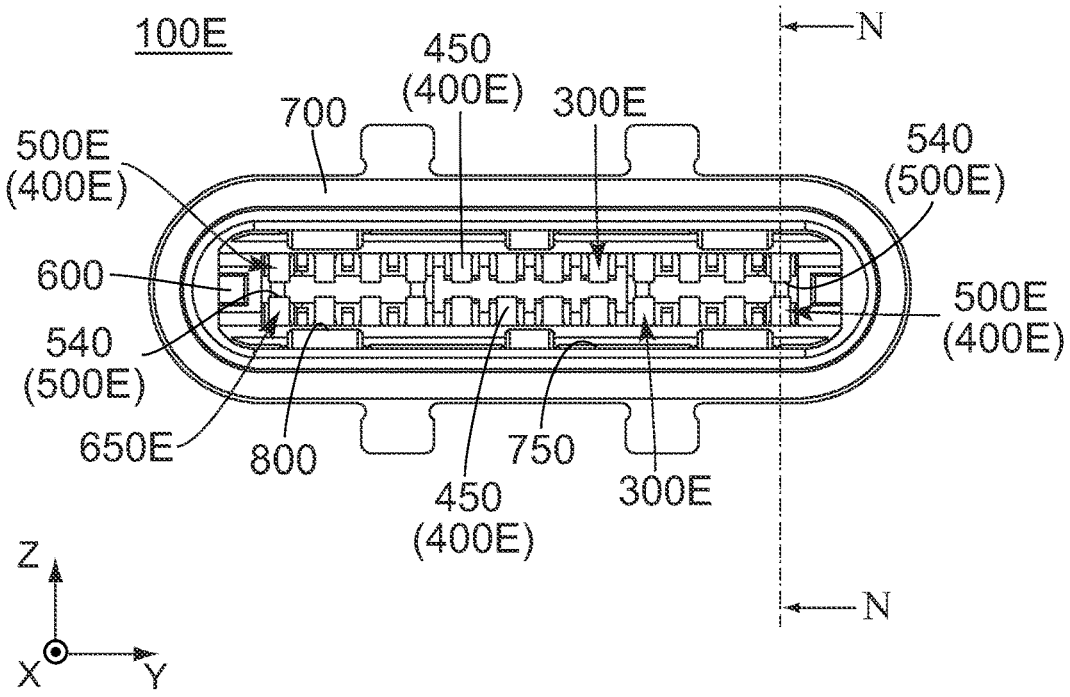
FIG. 48 is a front view showing the connector of FIG. 47.
Figure 49:
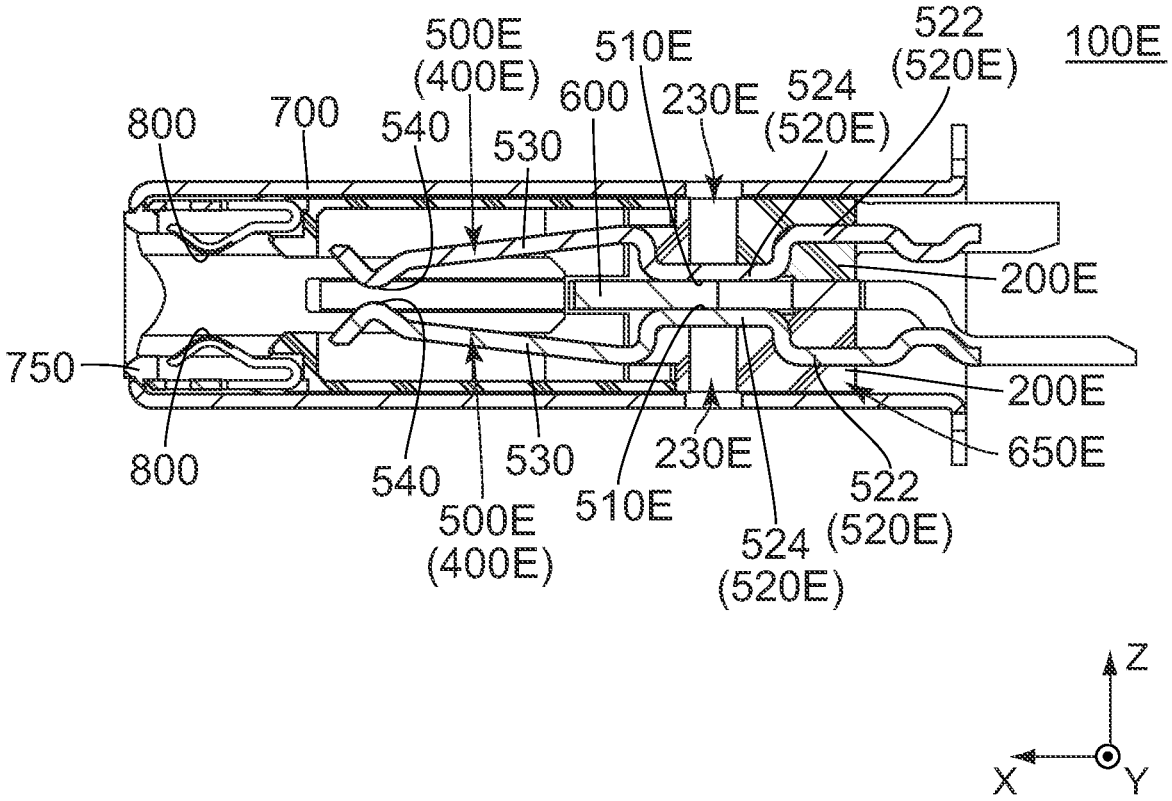
FIG. 49 is a cross-sectional view showing the connector of FIG. 48, taken along line N-N.

Referring to FIG. 47, a connector 100E according to a sixth embodiment of the present invention is a modification of the connector 100 of the first embodiment as shown in FIG. 1. Referring to FIG. 48, the connector 100E of the present embodiment is mateable along the front-rear direction with a mating connector (not shown) which comprises mating contacts (not shown). As shown in FIGS. 48 and 49, the connector 100E of the present embodiment comprises two holding members 200E, two terminal rows 300E, a midplate 600, a shell 700, a front insulator 750 and two ground springs 800. The two holding members 200E, the two terminal rows 300E and the midplate 600 form a structural body 650E. The connector 100E of the present embodiment has a structure similar to that of the connector 100 according to the aforementioned first embodiment except for the holding members 200E, the terminal rows 300E and the structural body 650E. Components of the connector 100E shown in FIGS. 47 to 52 which are same as those of the connector 100 of the first embodiment are referred by using reference signs same as those of the connector 100 of the first embodiment. As for directions and orientations in the present embodiment, expressions same as those of the first embodiment will be used hereinbelow.

Figure 50:
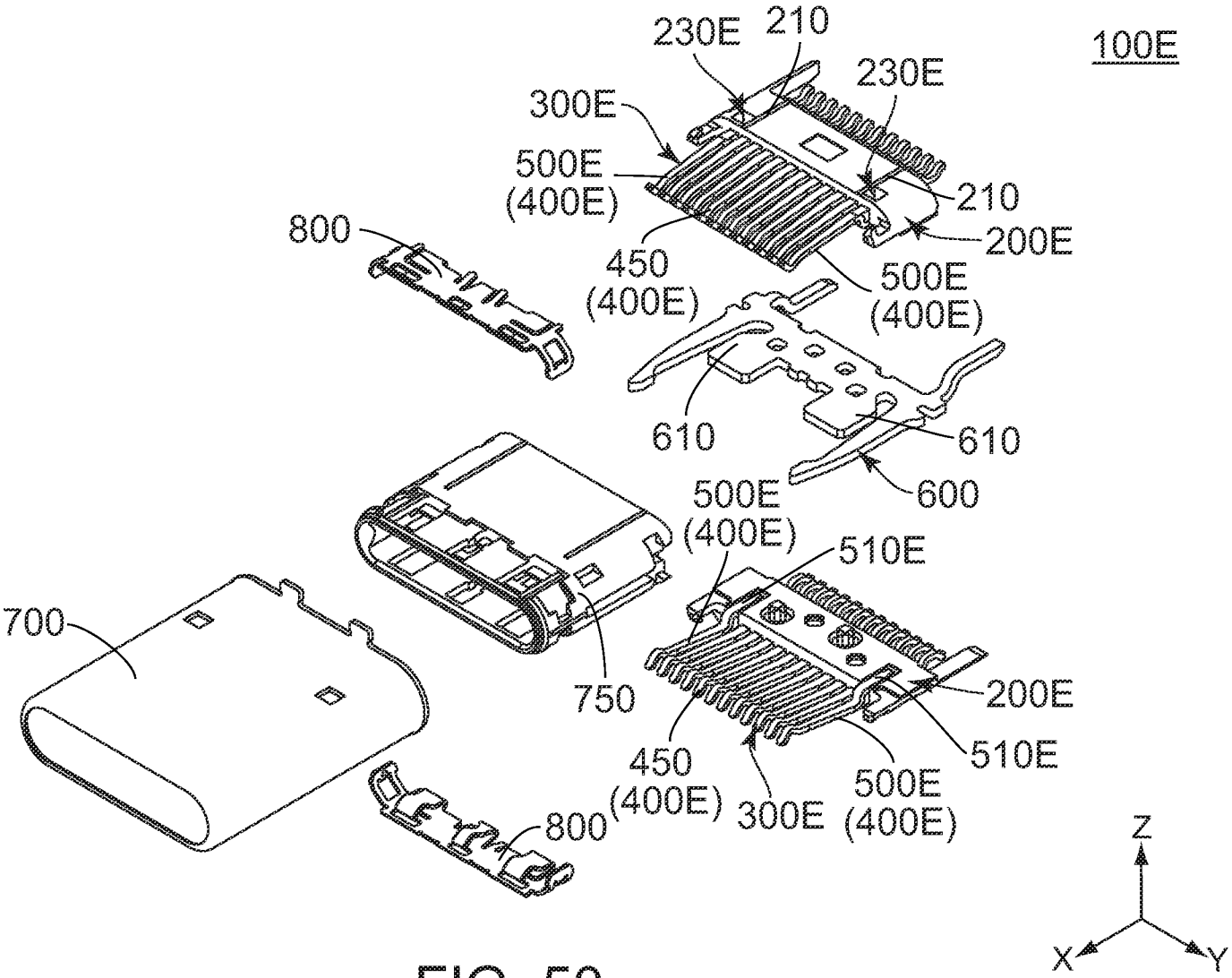
FIG. 50 is an exploded, perspective view showing the connector of FIG. 47.
Figure 51:
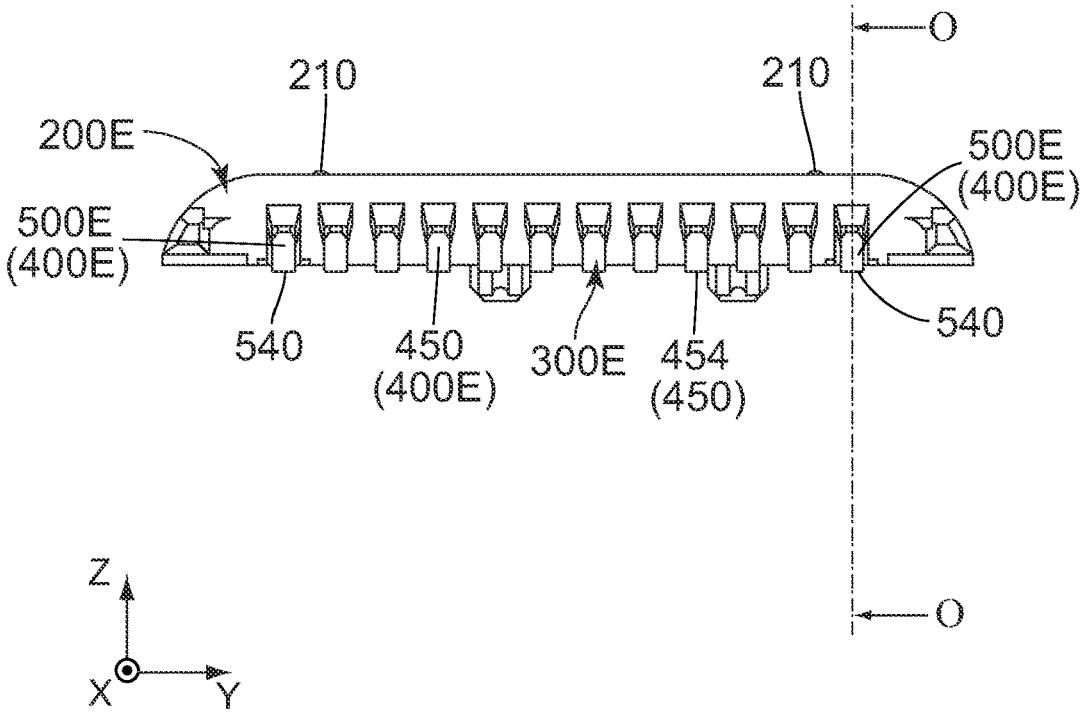
FIG. 51 is a front view showing a set of one of terminal rows and one of holding members, wherein the terminal rows and the holding members are included in the connector of FIG. 50.

Referring to FIG. 50, each of the holding members 200E of the present embodiment is made of resin. The holding members 200E correspond to the terminal rows 300E, respectively. Each of the terminal rows 300E is held by the corresponding holding member 200E. More specifically, each of the terminal rows 300E is insert-molded in the corresponding holding member 200E. As shown in FIG. 49, the holding members 200E are positioned away from each other in the up-down direction with the midplate 600 left therebetween in the up-down direction. Each of the holding members 200E is lightly press-fit into the shell 700. As shown in FIG. 50, each of the holding members 200E is formed with a plurality of light press-fit portions 210. More specifically, each of the holding members 200E is formed with two of the light press-fit portions 210. However, the present invention is not limited thereto. Specifically, one of the holding member 200E and the shell 700 should be formed with at least one light press-fit portion 210. The light press-fit portion 210 of the present embodiment has a structure same as that of the light press-fit portion 210 of the first embodiment. Accordingly, detailed explanation thereabout is omitted.

Referring to FIG. 50, each of the holding members 200E is formed with two holes 230E. However, the present invention is not limited thereto, but the number of the hole 230E may be one.

Referring to FIGS. 49 and 50, each of the holes 230E of the present embodiment has a substantially rectangular cylindrical shape extending in the up-down direction. The hole 230E neighbors to the light press-fit portion 210 in the pitch direction. Specifically, the holes 230E correspond to the light press-fit portions 210, respectively, and each of the holes 230E neighbors to the corresponding light press-fit portion 210 in the pitch direction. More specifically, in the pitch direction, each of the holes 230E is positioned outward beyond the corresponding light press-fit portion 210 and neighbors to the corresponding light press-fit portion 210. In other words, each of the light press-fit portions 210 neighbors to the corresponding hole 230E in the pitch direction. More specifically, in the pitch direction, each of the light press-fit portions 210 is positioned inward beyond the corresponding hole 230E and neighbors to the corresponding hole 230E.

As shown in FIG. 48, the terminal rows 300E of the present embodiment are positioned away from each other in the up-down direction with the midplate 600 left therebetween in the up-down direction. As shown in FIG. 50, each of the terminal rows 300E is held by the corresponding holding member 200E. More specifically, each of the terminal rows 300E is insert-molded in the corresponding holding member 200E. Each of the terminal rows 300E has a plurality of terminals 400E.

Referring to FIG. 50, each of the terminals 400E of the present embodiment is made of metal. In each terminal row 300E, the terminals 400E are arranged in the pitch direction. The terminals 400E of each of the terminal rows 300E include a plurality of signal terminals 450 and two specific terminals 500E. However, the present invention is not limited thereto. Specifically, the terminals 400E of each of the terminal rows 300E should include at least one specific terminal 500E. The signal terminal 450 of the present embodiment has a structure same as that of the signal terminal 450 of the first embodiment. Accordingly, detailed explanation thereabout is omitted.

As shown in FIG. 50, each of the specific terminals 500E of the present embodiment has an exposed portion 510E.

Figure 52:
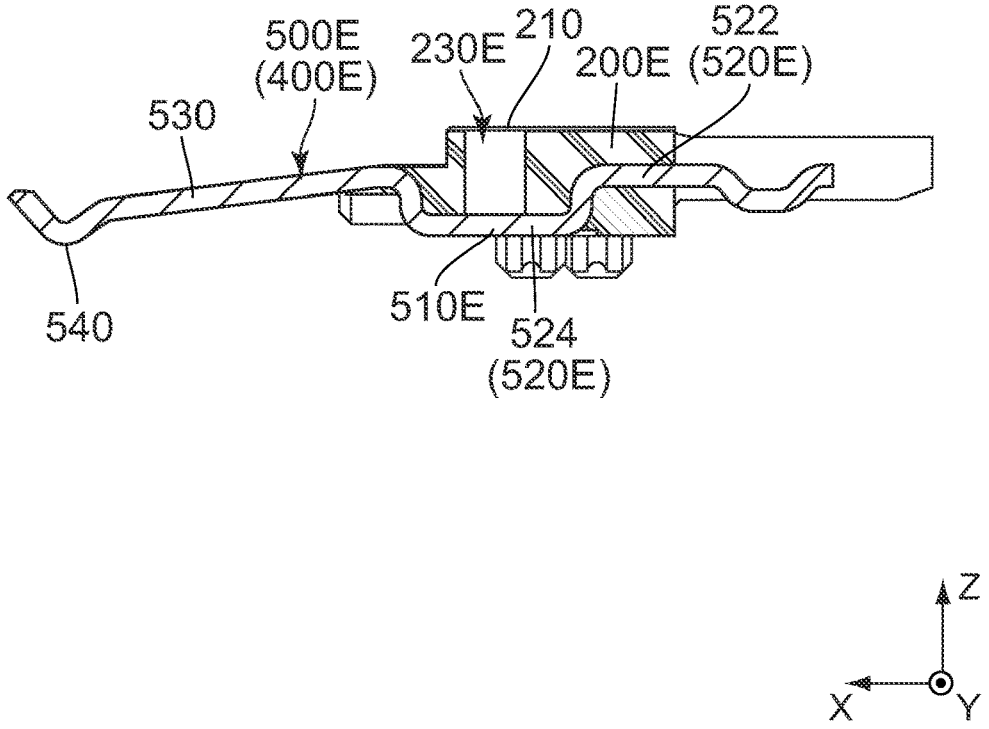
FIG. 52 is a cross-sectional view showing the set of the terminal row and the holding member of FIG. 51, taken along line O-O.
Figure 53:
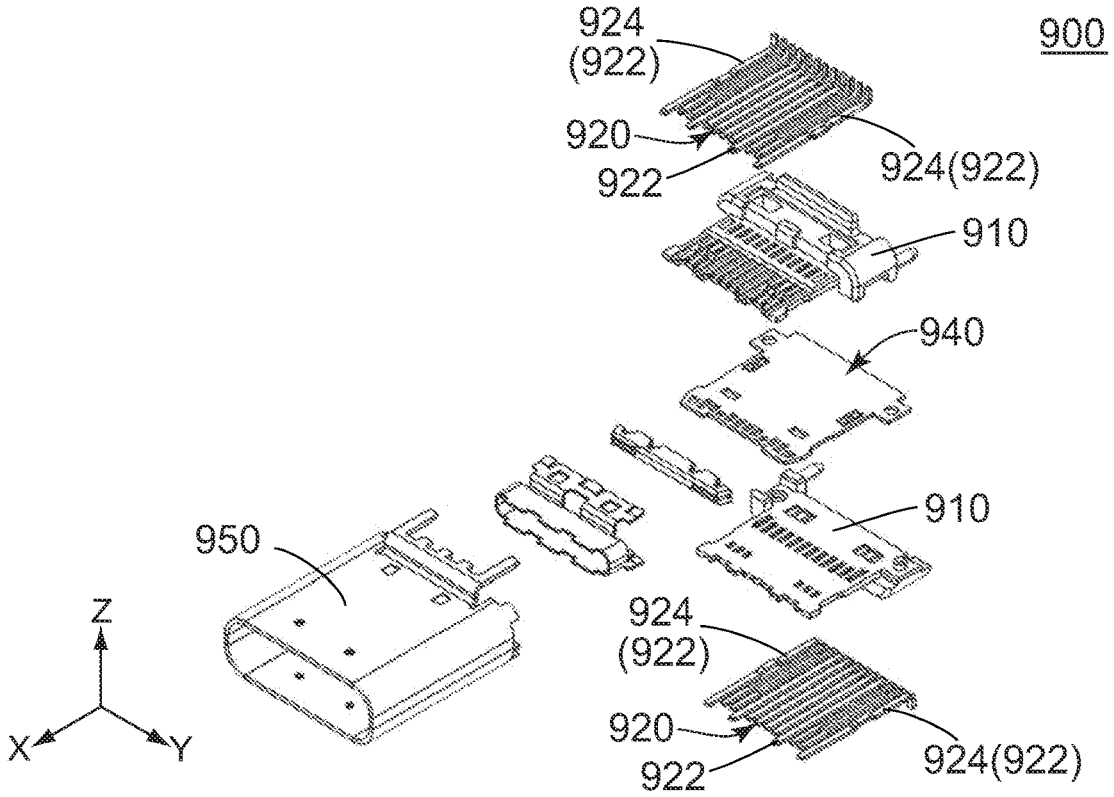
FIG. 53 PRIOR ART
FIG. 53 is an exploded, perspective view showing a connector of Patent Document 1.
Figure 54:
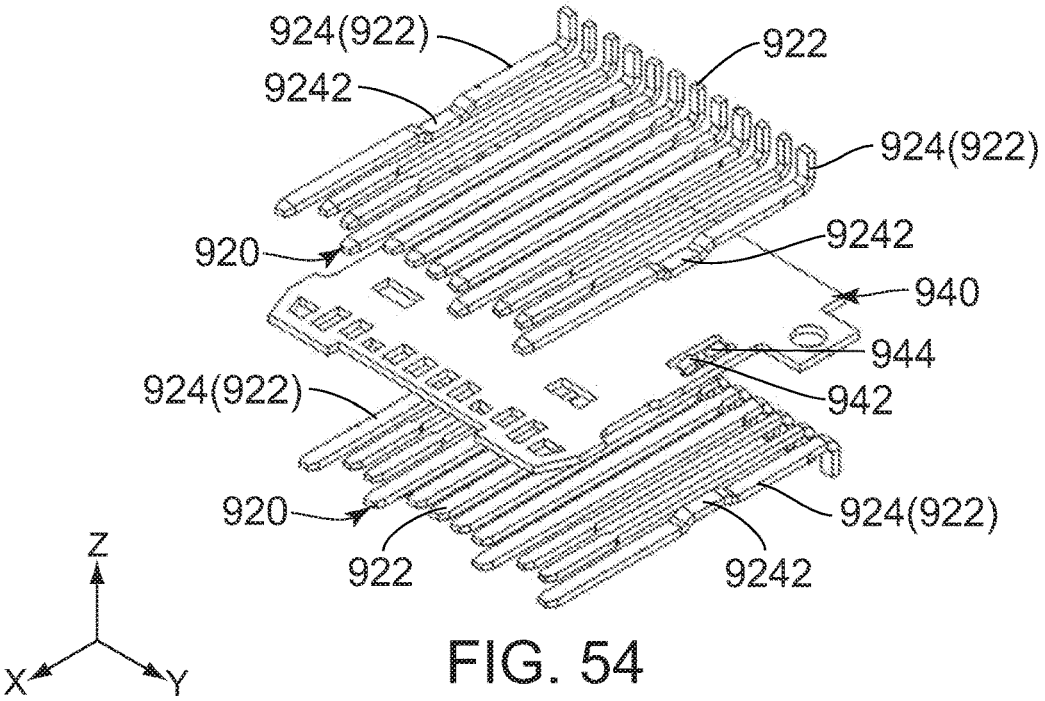
FIG. 54 PRIOR ART
FIG. 54 is a perspective view showing a midplate and terminal rows which are included in the connector of FIG. 53.

As shown in FIG. 50, the exposed portion 510E of the present embodiment has a plate-like shape intersecting with the up-down direction. More specifically, the exposed portion 510E is perpendicular to the up-down direction. The exposed portion 510E is exposed from the holding member 200E in the up-down direction. However, the present invention is not limited thereto. Specifically, the exposed portion 510E should be, at least in part, exposed from the holding member 200E in the up-down direction perpendicular to the pitch direction. As shown in FIG. 52, a position of the light press-fit portion 210 overlaps with a position of the exposed portion 510E in the front-rear direction perpendicular to both the up-down direction and the pitch direction. The hole 230E reaches the exposed portion 510E in the up-down direction. As shown in FIG. 49, the exposed portion 510E is positioned between the hole 230E and the midplate 600 in the up-down direction. The exposed portion 510E is welded to the midplate 600.

As described above, the connector 100E of the present embodiment is configured so that the hole 230E of the holding member 200E reaches the exposed portion 510E in the up-down direction. This configuration of the present embodiment facilitates delivery of laser radiation to the exposed portion 510E through the hole 230E when the exposed portion 510E of the specific terminal 500E is laser welded to the midplate 600. Instead of laser welding, resistance welding may be used to weld the exposed portion 510E to the midplate 600. In this case, an electrode can be brought into contact with the exposed portion 510E by inserting the electrode into the hole 230E of the holding member 200E from an outer side of the holding member 200E in the up-down direction. Thus, in this case, the aforementioned configuration of the present embodiment facilitates welding of overlapped parts of the exposed portion 510E of the specific terminal 500E, which is positioned above the midplate 600, the midplate 600 and the exposed portion 510E of the specific terminal 500E which is positioned below the midplate 600.

As shown in FIG. 52, the specific terminal 500E of the present embodiment has a held portion 520E, a supporting portion 530 and a contact portion 540. The supporting portion 530 and the contact portion 540 of the present embodiment have structures same as those of the supporting portion 530 and the contact portion 540 of the first embodiment. Accordingly, detailed explanation thereabout is omitted. The held portion 520E of the present embodiment has a configuration similar to that of the held portion 520 of the first embodiment except that the held portion 520E is formed with the exposed portion 510E. Accordingly, detailed explanation thereabout is omitted.

Although the specific explanation about the present invention is made above referring to the embodiments, the present invention is not limited thereto and is susceptible to various modifications and alternative forms.

Although each of the light press-fit portions 210 of the aforementioned embodiments is provided on the holding member 200, 200A, 200B, 200C, 200E and is the projecting rib which protrudes outward in the up-down direction and extends in the front-rear direction, the present invention is not limited thereto. Specifically, the light press-fit portion 210 may be a protrusion which protrudes outward in the up-down direction from the holding member 200, 200A, 200B, 200C, 200E. Alternatively, the light press-fit portion 210 may be a projecting rib or protrusion which protrudes inward in the up-down direction from the shell 700. However, the light press-fit portion 210 of the present embodiment is more preferable because the light press-fit portion 210 of the present embodiment facilitates the attitude of the terminal row 300, 300C, 300D, 300E, which is held by the holding member 200, 200A, 200B, 200C, 200E, relative to the shell 700 to be maintained horizontal.

Although each of the holding members 200, 200A, 200B, 200C, 200E is provided with the two light press-fit portions 210 in the connector 100, 100C, 100D, 100E of the aforementioned embodiments, the present embodiment is not limited thereto. Specifically, each of the holding members 200, 200A, 200B, 200C, 200E may be provided with the single light press-fit portion 210. In other words, the connector 100, 100C, 100D, 100E of the aforementioned embodiments may have two of the light press-fit portions 210 each provided on the holding member 200, 200A, 200B, 200C, 200E.

Although the connector 100, 100C, 100D, 100E of the aforementioned embodiment comprises the front insulator 750 and the ground springs 800, the present invention is not limited thereto. Specifically, the connector 100, 100C, 100D, 100E may comprise no front insulator 750. Additionally, the connector 100, 100C, 100D, 100E may comprise no ground spring 800.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector comprising two holding members, two terminal rows, a midplate and a shell, wherein:

the holding members correspond to the terminal rows, respectively;

each of the holding members is lightly press-fit into the shell;

each of the terminal rows is held by the corresponding holding member;

each of the terminal rows has a plurality of terminals;

in each terminal row, the terminals are arranged in a pitch direction;

the terminals of each of the terminal rows include a specific terminal;

the specific terminal has an exposed portion;

the exposed portion is, at least in part, exposed from within the holding member in an up-down direction perpendicular to the pitch direction;

the midplate is sandwiched by the holding members in the up-down direction;

the midplate has a receiving portion;

the exposed portion is brought into contact with the receiving portion;

one of the holding member and the shell is formed with at least one light press-fit portion; and a position of the at least one light press-fit portion overlaps with a position of the exposed portion in a front-rear direction perpendicular to both the up-down direction and the pitch direction.

2. The connector as recited in claim 1, wherein:

the specific terminal has a held portion, a supporting portion and a contact portion;

the held portion is, at least in part, held by the holding member;

the exposed portion is formed on the held portion;

the supporting portion is resiliently deformable and extends forward in the front-rear direction from the held portion; and the contact portion is supported by the supporting portion so as to be movable in the up-down direction.

3. The connector as recited in claim 1, wherein:

the at least one light press-fit portion includes two of the light press-fit portions;

the light press-fit portions are formed on the holding members, respectively; and each of the light press-fit portions is a projecting rib which protrudes outward in the up-down direction and extends in the front-rear direction.

4. The connector as recited in claim 2, wherein:

the held portion has an embedded portion and a protruding portion;

the embedded portion is embedded in the holding member;

the protruding portion is positioned forward of the embedded portion in the front-rear direction;

the protruding portion protrudes toward the midplate beyond any of the embedded portion and the supporting portion;

the supporting portion extends forward in the front-rear direction from the protruding portion; and the exposed portion is provided on the protruding portion.

5. The connector as recited in claim 4, wherein the protruding portion is, at least in part, covered by the holding member at any place of the protruding portion in the front-rear direction.

6. The connector as recited in claim 5, wherein the protruding portion is covered by the holding member except for the exposed portion.

7. The connector as recited in claim 1, wherein:

the holding member is provided with a hole;

the hole reaches the exposed portion in the up-down direction; and the light press-fit portion neighbors to the hole in the pitch direction.

8. The connector as recited in claim 1, wherein the exposed portion is pressed against the receiving portion.

9. The connector as recited in claim 8, wherein:

the exposed portion is provided with a protrusion; and the protrusion is pressed against the midplate.

10. The connector as recited in claim 1, wherein:

the holding member is provided with a hole;

the hole reaches the exposed portion in the up-down direction;

the exposed portion is positioned between the hole and the midplate in the up-down direction and is welded to the midplate.

11. The connector as recited in claim 10, wherein the light press-fit portion neighbors to the hole in the pitch direction.

12. The connector as recited in claim 1, wherein:

the connector further comprises a front insulator and two ground springs;

the front insulator has a substantially tube shape;

the front insulator is positioned forward of any of the holding members in the front-rear direction;

the front insulator is held by the shell;

the specific terminal has a supporting portion and a contact portion;

the supporting portion is resiliently deformable;

the contact portion is supported by the supporting portion so as to be movable in the up-down direction;

each of the supporting portion and the contact portion is positioned in the front insulator; and each of the ground springs is partially sandwiched by the shell and the front insulator and is held by the shell and the front insulator.

* * * * *